US009394696B2

(12) United States Patent
Norwood et al.

(10) Patent No.: US 9,394,696 B2
(45) Date of Patent: Jul. 19, 2016

(54) SYSTEM AND METHOD FOR A VENTED AND WATER CONTROL SIDING, VENTED AND WATER CONTROL SHEATHING AND VENTED AND WATER CONTROL TRIM-BOARD

(71) Applicant: Norwood Architecture, Inc., Louisville, CO (US)

(72) Inventors: Steven Norwood, Louisville, CO (US); Amir Abu-Jaber, Boulder, CO (US)

(73) Assignee: NORWOOD ARCHITECTURE, INC., Louisville, CO (US)

( * ) Notice: Subject to any disclaimer, the term of this patent is extended or adjusted under 35 U.S.C. 154(b) by 0 days.

(21) Appl. No.: 14/622,526

(22) Filed: Feb. 13, 2015

(65) Prior Publication Data

US 2015/0233121 A1 Aug. 20, 2015

Related U.S. Application Data

(60) Provisional application No. 61/940,285, filed on Feb. 14, 2014, provisional application No. 61/955,702, filed on Mar. 19, 2014.

(51) Int. Cl.
*E04F 13/00* (2006.01)
*E04F 13/072* (2006.01)
*E04F 13/08* (2006.01)

(52) U.S. Cl.
CPC ..... *E04F 13/007* (2013.01); *E04F 13/072* (2013.01); *E04F 13/0864* (2013.01)

(58) Field of Classification Search
CPC ... E04F 13/007; E04F 13/072; E04F 13/0864; E04C 2/46; E04C 2/523
See application file for complete search history.

(56) References Cited

U.S. PATENT DOCUMENTS

| | | | | |
|---|---|---|---|---|
| 2,264,961 | A * | 12/1941 | Ward | E04B 1/767 52/302.3 |
| 2,724,872 | A * | 11/1955 | Herbes | 52/553 |
| 3,288,998 | A * | 11/1966 | Press, Jr. | 250/336.1 |
| 3,538,668 | A * | 11/1970 | Anderson | 52/783.18 |
| 4,064,300 | A * | 12/1977 | Bhangu | 428/120 |
| 4,348,442 | A * | 9/1982 | Figge | 428/72 |
| 5,050,357 | A * | 9/1991 | Lawson | E04D 5/12 52/314 |
| 6,017,597 | A * | 1/2000 | Minakami et al. | 428/34.4 |
| 6,298,620 | B1 * | 10/2001 | Hatzinikolas | 52/302.1 |
| 7,117,651 | B2 | 10/2006 | Beck | |
| 7,472,523 | B2 * | 1/2009 | Beck | 52/748.1 |
| 7,748,190 | B1 * | 7/2010 | Loper | E04F 13/0864 411/466 |
| 7,765,754 | B2 | 8/2010 | Johnson et al. | |
| 8,225,568 | B1 * | 7/2012 | Mollinger et al. | 52/302.4 |
| 8,440,289 | B2 * | 5/2013 | De Giuseppe | 428/167 |

(Continued)

OTHER PUBLICATIONS

International Search Report and Written Opinion issued in related PCT/US15/15921 on May 20, 2015, 9 pages.

*Primary Examiner* — Rodney Mintz
(74) *Attorney, Agent, or Firm* — Lathrop & Gage LLP

(57) ABSTRACT

A vented and water control paneling has improved drainage and integrated ventilation air space. The water control paneling may be fabricated with an omnidirectional relief pattern formed on its back surface. The relief pattern spaces the vented and water control paneling away from a structure to which it is secured, thereby providing an omnidirectional drainage plane between the back surface of the paneling and the structure. The omnidirectional drainage plane provides an unimpeded ventilation and drainage path of water and/or water vapor.

36 Claims, 23 Drawing Sheets

(56) References Cited

U.S. PATENT DOCUMENTS

| | | | | |
|---|---|---|---|---|
| 8,590,217 | B2 | 11/2013 | Gleeson et al. | |
| 9,022,845 | B2 * | 5/2015 | Henderson | F24F 7/02 29/897.3 |
| 9,109,363 | B2 * | 8/2015 | Grau | E04C 2/30 52/302.1 |
| 9,260,864 | B2 * | 2/2016 | Cole | E04F 13/148 52/302.1 |
| 9,309,678 | B1 * | 4/2016 | Mollinger | E04F 13/18 52/309.4 |
| 2001/0054263 | A1 * | 12/2001 | Coulton | 52/199 |
| 2003/0024192 | A1 * | 2/2003 | Spargur | 52/309.4 |
| 2006/0075712 | A1 * | 4/2006 | Gilbert et al. | 52/520 |
| 2007/0175154 | A1 * | 8/2007 | Wilson et al. | 52/521 |
| 2009/0007517 | A1 | 1/2009 | Swanson | |
| 2009/0113838 | A1 | 5/2009 | Paulsen et al. | |
| 2010/0189953 | A1 * | 7/2010 | Lim | 428/119 |
| 2010/0281801 | A1 * | 11/2010 | Shaw | B32B 5/18 52/302.1 |
| 2012/0047839 | A1 * | 3/2012 | Walker | 52/580 |
| 2012/0047844 | A1 * | 3/2012 | Walker | 52/741.4 |
| 2012/0096790 | A1 | 4/2012 | Wilson et al. | |
| 2012/0247040 | A1 * | 10/2012 | Buoni et al. | 52/302.1 |
| 2013/0199121 | A1 * | 8/2013 | Grau | E04C 2/30 52/588.1 |
| 2014/0093678 | A1 * | 4/2014 | Walker | 428/106 |
| 2015/0047281 | A1 * | 2/2015 | Cole et al. | 52/302.1 |
| 2015/0082722 | A1 * | 3/2015 | Kalkanoglu | E04D 1/30 52/302.1 |
| 2015/0176283 | A1 * | 6/2015 | Smiley, Jr. | E04D 13/17 52/105 |
| 2016/0040436 | A1 * | 2/2016 | Grau | E04C 2/30 52/539 |

* cited by examiner

SYSTEM AND METHOD FOR A VENTED AND WATER CONTROL SIDING, VENTED AND WATER CONTROL SHEATHING AND VENTED AND WATER CONTROL TRIM-BOARD

RELATED APPLICATIONS

This application claims priority to U.S. Provisional Application Ser. No. 61/940,285 filed on Feb. 14, 2014. This application also claims priority to U.S. Provisional Application Ser. No. 61/955,702 filed on Mar. 19, 2014. Each of the aforementioned applications is incorporated by reference in their entirety.

BACKGROUND

The exterior walls of buildings are comprised of multiple elements that provide structural support and bracing as well as weather protection for the structure and the interior elements of the building. Typical structural elements include columns, beams, studs, and sheathing. Weather protection elements include siding, panel siding, trim, various cladding systems, and, in some cases, the sheathing. When used on the exterior of a building, sheathing may be applied to the outer face of studs, roof trusses, or rafters of the building to brace the structure, resist wind and other loads and to provide a backing for the exterior weatherproofing systems. In cases, the sheathing itself can serve as one of the weatherproofing elements of the building. Sheathing can be manufactured from a variety of materials including wood, cement, gypsum, insulation, foam insulation, or other suitable materials. Sheathing panels are typically attached directly to wall framing or roof framing members and are typically covered with a wall cladding, siding, or roofing. One example of sheathing is Oriented Strand Board ("OSB"). OSB is a wood and resin based sheathing product typically manufactured in four foot by eight foot sheets. The OSB sheathing is an engineered product used in wood frame construction in applications that historically used plywood or solid sawn wood members. OSB sheathing is typically manufactured with smooth or slightly roughened faces and can be used as a subfloor, roof sheathing, or wall sheathing, among other uses. When used as roof sheathing, the roughened surface of the OSB provides a slip resistant walking surface. When used as wall sheathing, the OSB is nailed or screwed to supporting wood framing. OSB sheathing is not oriented in a particular horizontal or vertical manner and can be cut into different sizes and shapes to sheath the underlying wood framing or furring.

Cladding may be formed from wood, "hardboard" or "pressboard," plastics, cement, gypsum, insulation, foam insulation, or other suitable materials. Cladding is generally referred to as an external weatherproofing element that is attached to the exterior sheathing or framing. The cladding is typically applied over a weather resistant membrane (as used herein the term includes building paper, felt, house-wrap, and similar products including liquid or spray applied breathable coatings). In addition to siding, trim, and panel siding, cladding systems include stucco, brick, stone and other materials used to cover the building and provide weather protection. Trim, siding, panel siding, and other cladding systems can trap moisture behind the cladding systems resulting in degradation of the building paper, underlying sheathing, and the wood framing.

Cement board siding, wood siding, and 'hardboard' siding or 'pressboard" siding are typically manufactured with a smooth 'back' or unexposed face, and a 'front' or exposed face, of the siding with a smooth finish or decorative patterns that simulate wood grain. Siding is a subset of cladding that is typically layered, or "lapped," on the exterior surface of the structure to shed water. For siding, the typical installation of the siding is lapped with the upper pieces of siding overlapping the lower pieces of siding as the siding is installed up the typical exterior wall face. This lapped siding installation allows water to shed down the exposed face of the siding. The 'back' or un-exposed face of the siding is typically in contact with the underlying sheathing or building paper. The siding is nailed through the face of the siding, through the sheathing if present, and into the underlying wood framing (studs) of the wall assembly. Some water will reach the back side of the siding and/or the face of the building paper, during rain, snow, or condensation events. In traditional siding, at each level of the siding installation, the back side of the siding is tight against the building paper. At these contact points, or 'pinch points' the flow of water down the building paper is potentially obstructed. In addition, the ventilation of the space behind the siding is potentially obstructed. In traditional siding, the back of siding cannot 'breathe' resulting in potential degradation of the building paper, underlying sheathing, the wood framing.

SUMMARY OF THE INVENTION

To reduce the potential for damage due to moisture and to create an omnidirectional ventilation space behind the siding, trim, or cladding, one embodiment of the present invention introduces raised patterns or bumps to the manufactured back side of siding, trim, or cladding. These raised bumps or patterns create a permanent, omnidirectional, air space and are integral to the manufactured siding, trim or cladding product.

To reduce the potential for damage due to moisture and to create a ventilation space between sheathing and the covering siding or cladding, one embodiment of the present invention introduces raised patterns or bumps to an outwardly facing surface of the sheathing. These raised bumps or patterns create a drainable ventilation space between the sheathing and siding, panel, or cladding materials that form the outer surface of a structure. The patterned sheathing may be covered with a spray applied weather resistant membrane, or other coating, providing increased weather resistance while maintaining the omnidirectional ventilation and drainage air space.

In an embodiment, a vented and water control panel for securing to the exterior of structure includes an omnidirectional relief pattern formed on a back surface of the vented and water control panel. The omnidirectional relief pattern forms an omnidirectional ventilation and drainage plane for moving water and water vapor. The vented and water control panel may be siding, trim-board, siding panel, or cladding element.

In an embodiment, a vented and water control panel sheathing is disclosed. The vented and water control panel sheathing includes a panel body having an outer face, and an inner face. The panel sheathing further includes a plurality of raised surface features extending from the outer face in the form of an omnidirectional relief pattern to provide points of contact between the sheathing and an exterior finish or cladding, when the exterior finish or cladding is applied with the sheathing. Also, a plurality of channels is formed between the raised surface features to facilitate omnidirectional draining and/or ventilation between the panel and the applied exterior finish or cladding. If used as an insulating panel, the sheathing may have an omnidirectional relief pattern on both the outer and inner face (both faces) of the panel.

In another aspect, a structure has improved water drainage and air ventilation, the structure includes a first layer having an interior facing surface and an exterior facing surface, the exterior facing surface having an omnidirectional relief pattern of raised elements thereon; wherein the omnidirectional relief pattern forms an omnidirectional ventilation and drainage plane.

DETAILED DESCRIPTION OF THE FIGURES

Figure 1:
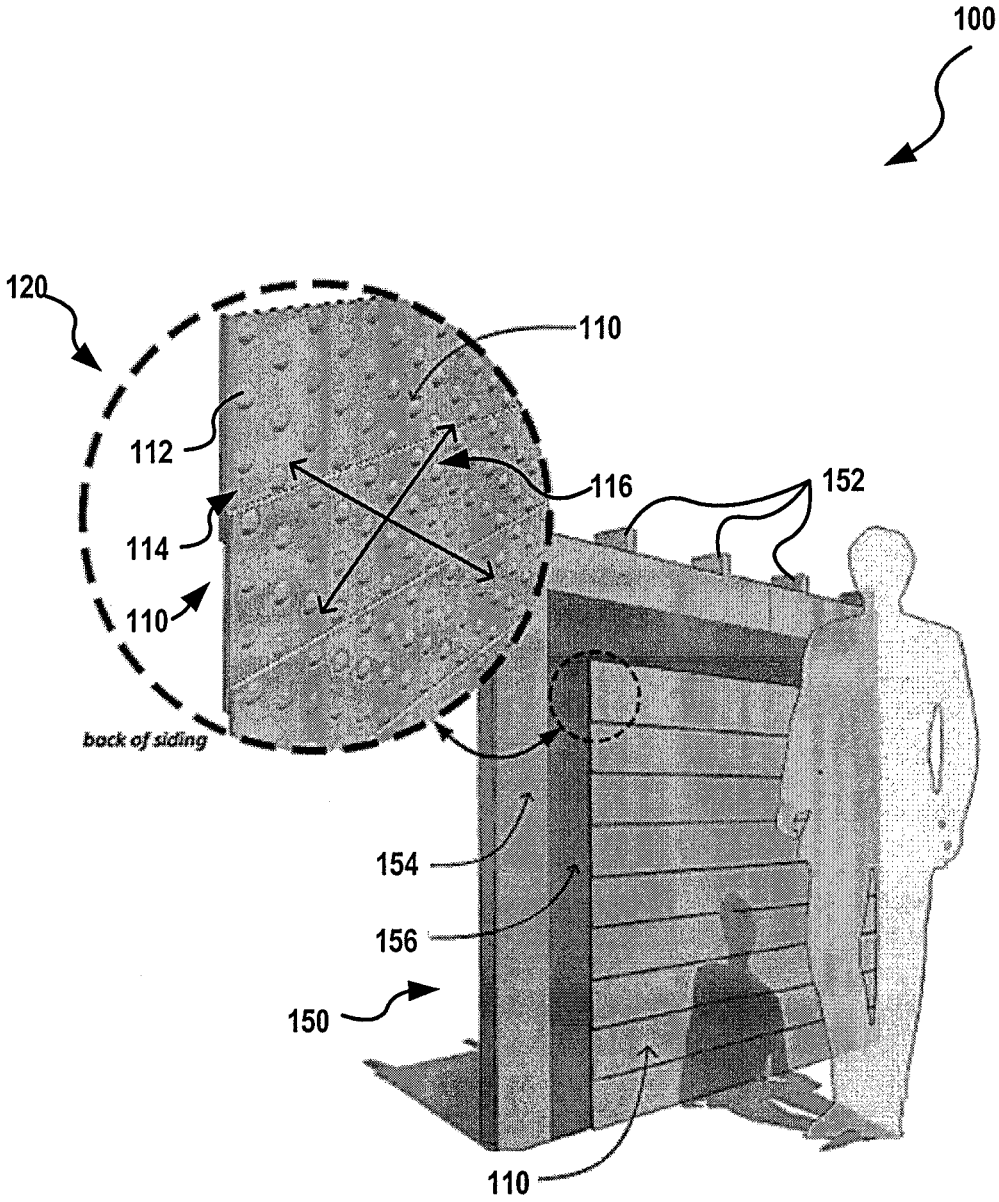
FIG. 1 is a perspective view of an exemplary vented and water control siding secured to a structure, in an embodiment.

Disclosed is a vented and water control siding, trim-board, cladding, and sheathing with improved omnidirectional drainage and integrated air space. The vented and water control siding, trim-board, or cladding may be formed as long, narrow sheets used in siding the exterior of a buildings, is fabricated with an omnidirectional relief pattern formed on the on its back (unexposed) surface. Omnidirectional relief pattern, as used herein means a three dimensional pattern of raised elements (or lowered elements) on the plane of a surface that allows for air ventilation or moisture drainage in any direction, and not solely a linear direction. The omnidirectional relief pattern holds the siding, trim-board, or cladding away from a structure to which it is secured (hereinafter called "the structure"), thereby providing a ventilation and drainage plane between the back surface of the siding and the structure. This drainage plane provides an omnidirectional path for air and water to flow, and is therefore an omnidirectional drainage plane. An omnidirectional path here means a path for a flow (e.g., air, water, or water vapor) to move substantially unimpeded both along a siding's or series of siding's length and width.

The vented and water control sheathing may be formed as sheets or panels used in sheathing the exterior of a buildings, is fabricated with an omnidirectional relief pattern formed on its front surface. The omnidirectional relief pattern holds subsequent siding or cladding away from the sheathing, thereby providing a drainage plane between the front surface of the sheathing and the siding or cladding. This drainage plane provides an omnidirectional drainage plane.

In the present description, the omnidirectional relief pattern is shown and described as a grid (or array) pattern of raised bumps or "dot" shaped structures and an egg-crate or other three-dimensional pattern of raised features, but it will be understood that any pattern and shaped structures that facilitates an omnidirectional drainage plane can be used without departing from the scope herein. For example, the "bumps" may be pyramids, squares, rectangles, or other shapes may be formed in a grid pattern. A feature of the raised "dot" and "egg-crate" shaped structures is the air space on all sides of the raised shaped structures, which facilitates water and air flow.

By providing an omnidirectional ventilation and drainage plane the risk of moisture related damage to the structure is significantly reduced. The omnidirectional drainage plane provided by the raised patterns allows moisture to spread unhindered over a large surface area, as such drainage is improved and an integrated air space is provided. This differs from the prior art structures, for example using furring strips or similar structures that only provide for a limited substantially linear drainage plane. For example, U.S. Pat. No. 7,472,523 to Beck ("the '523 Patent"), entitled "Rainscreen Clapboard Siding" discloses siding with linear protrusions or recesses on the backside of clapboard siding. These protrusions are described as "preferably oriented substantially vertical to the bottom edge 106, i.e., perpendicular to the bottom edge, but may vary as much as ±85° from vertical." (3:38-41). The vertical and horizontal protrusions or recesses of the '523 Patent fail to provide omnidirectional drainage, but instead are limited to a linear drainage plane defined by the direction of the vertical or horizontal protrusions/recesses. In addition, the present system eliminates the need for additional structure, such as furring strips, which increase cost and associated with additional material and labor.

The prior art systems that utilize a linear drainage plane contain moisture in a restricted space, which may cause the linear drainage plane to become saturated. Additionally, air flow is limited, which would otherwise facilitate the removal of moisture and drying of the assembly. The omnidirectional pattern of the present invention resists saturation and allows air flow from any direction. The present invention resists plane saturation by allowing moisture to disperse over a large surface area. This has the additional benefit of exposing the moisture to substantially unrestricted air flow, increasing the rate of moisture removal by transferring moisture from the provided space to the moving air.

Siding, trim-board, cladding, or sheathing with an omnidirectional relief pattern formed on one surface may be fabricated from a number of materials, such as, but not limited to, OSB, cement, fiber reinforced cement, gypsum, paper backed gypsum, insulation, foam insulation, wood or wood products, etc.

Patterned Siding

FIG. 1 shows a vented and water control siding system 100 formed as a plurality of vented and water control siding 110. In FIG. 1, siding 110 is secured to a structure 150 formed of an optional weather resistant barrier 156, and a standard sheathing 154 secured to a frame 152. Optional weather resistant barrier 156 may be any barrier, for example building paper, although other barriers or no barrier may be used without departing from the scope herein. In addition, sheathing 154 may be plywood, OSB, particle board, gypsum sheathing, insulation, foam insulation, or any other similar material known in the industry. Frame 152 may be fabricated from wood framing members for example 2×4, 2×6 etc., or metal framing members for example steel studs or the like, or any other framing member know in the industry.

Window 120 shows a back surface 114 of siding 110. Formed on back surface 114 of siding 110 is an omnidirectional relief pattern formed as a grid of raised elements 112. When secured to structure 150, raised elements 112 space back surface 114 of siding 110 away from sheathing 154 or optional barrier 156, thereby creating an omnidirectional drainage plane 116 (arrows shown are exemplary of drainage plane 116 only, and do not limit drainage to any particular direction within plane 116).

In the present example, siding 110 is formed from fiber cement material with raised elements 112 formed on back surface 114 utilizing an embossing process, although other materials and techniques may be used without departing from the scope herein.

Figure 2A:
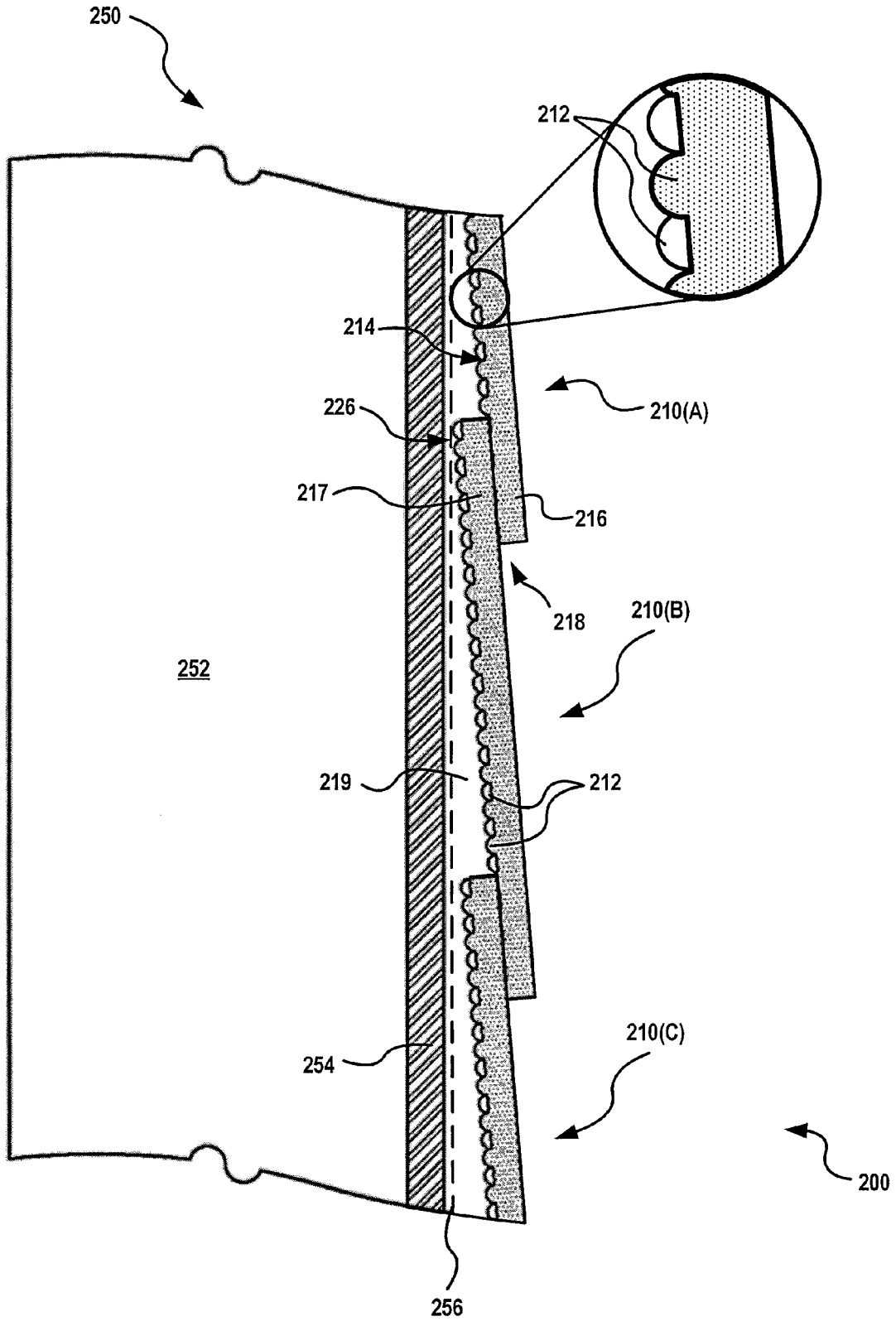
FIG. 2A is a side view of a vented and water control siding utilizing a raised pattern of bumps or dots, overlapping features, and secured to a structure, in an embodiment.

FIG. 2A shows a close-up of system 200, formed of multiple sidings 210(A)-(C), all secured to a structure 250. Similar to structure 150 of FIG. 1, structure 250 is formed of a weather resistant barrier 256, a sheathing 254, and a frame 252. In FIG. 2A, drainage elements are raised elements 212 organized on a grid pattern on a back surface 214 of siding 210, similar to that shown in FIG. 1. A bottom portion 216 of siding 210(A) overlaps a top portion 217 of siding 210(B) creating a seal 218 for sealing a region 219 between siding 210 and structure 250. Region 219 may vent/drain via a drainage plain provided at regions 226 by raised elements 212, such that water, water vapor, and air move substantially freely in region 219.

Figure 2B:
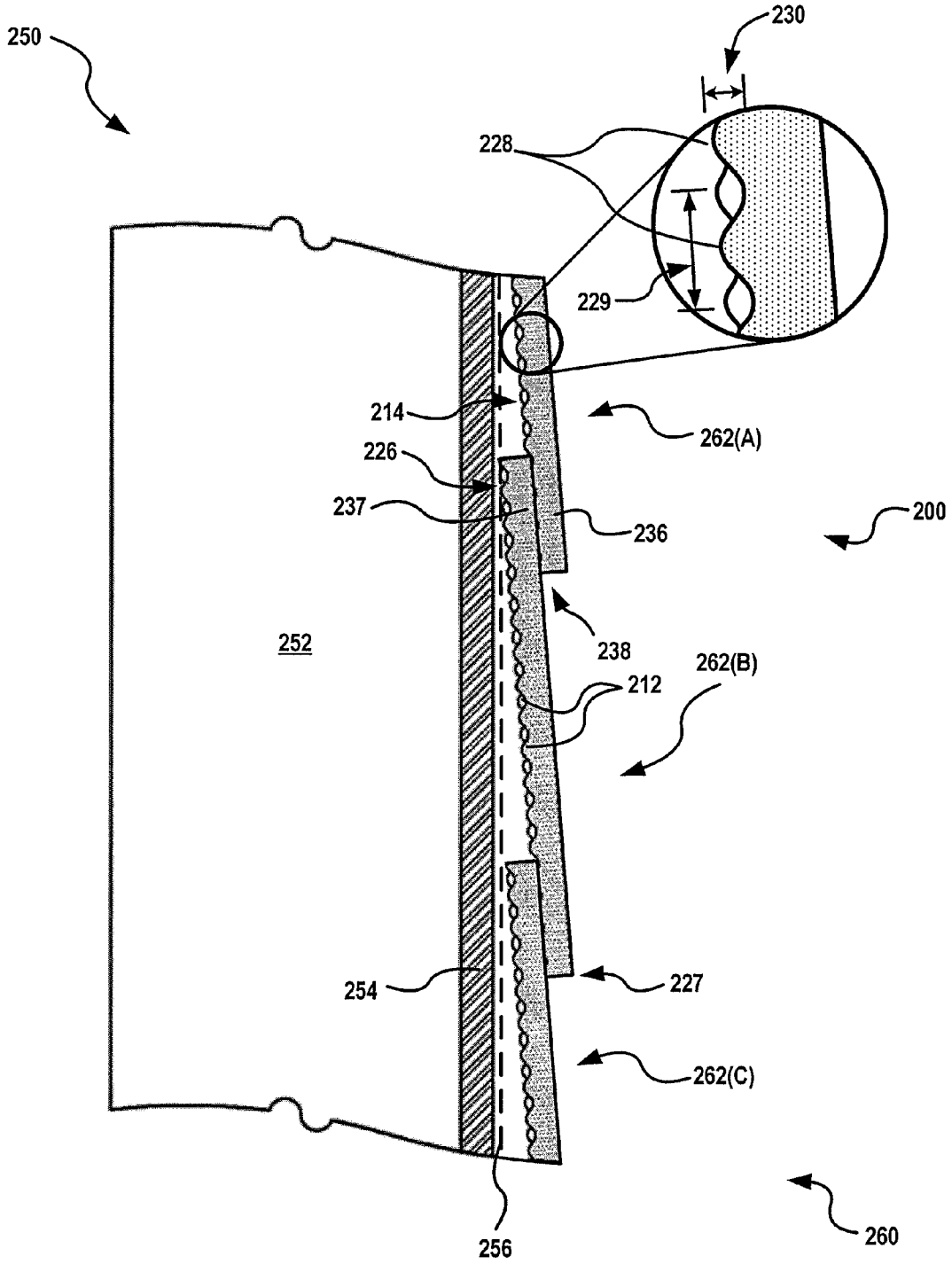
FIG. 2B is a side view of a vented and water control siding utilizing an egg crate/three-dimensional pattern, overlapping features, and secured to a structure, in an embodiment.

FIG. 2B shows an illustrative representation of water control siding system 260, formed of multiple pieces of siding 262(A)-(C), all secured to structure 250, similar to structure 250 of FIG. 2. In the embodiment of FIG. 2B, siding 262(A)-(C) is formed with raised elements 228 organized as an "egg-crate" or other three-dimensional pattern on its interior surface, and a square corner on its bottom outer corner 227.

In the embodiment of FIG. 2B, a bottom portion 236 of an upper siding 262(A) overlaps a top portion 237 of an adjacent, lower siding 262(B) such that a seal 238 is formed between the upper and lower siding. Raised elements 228 form a ventilation and drainage space 226 between each siding 262 and structure 250. Drainage space 226 provides a path for water, water vapor to migrate away from the space between structure 250 and the plurality of siding 262(A)-(C).

In an embodiment, siding 226 is fabricated with a thickness of approximately ½ of an inch, that is, ⅜ of an inch of substantially solid material and ⅛ of an inch for the embossed three-dimensional pattern, and approximately 6 inches wide. The separation distance 229 between the peaks on siding 262's exemplary egg-crate pattern are spaced such that during installation, for example, by fixing to structure 250 with nails or screws, siding 262 is not prone to cracking. An exemplary separation distance 229 is ½ of an inch, although this may vary depending on the type of material used to make siding 262, the thickness of siding 262, etc. In an embodiment, a height 230 of the three dimensional pattern is optimized to facilitate drainage while maintaining structural integrity. In this embodiment, height 230 is $\frac{1}{8}^{th}$ of an inch. It will be understood that separation distance 229 and height may be selected to be greater than or less than the measurements disclosed here, for example, to compensate for environments with more or less humidity. Further, the height of the omnidirectional relief pattern elements may taper from the top of the siding or panel to the bottom of the siding or panel, or vice versa. It will be understood that siding 262 may be formed with any industry standard dimension, or any other dimension, without departing from the scope herein. The length of siding 262 may be of any industry standard length, for example, that conforms to fabrication and installation practices.

It will be understood that raised elements 212, 228 may additionally be utilized for alignment purposes during installation of siding 210, 262 by aligning raised elements 212, 228 with the outer top corner of the next lowest, adjacent siding 210, 262, as shown in FIGS. 2A and 2B. For example, the exterior surface of the siding or cladding panel may include a securing hole that corresponds to one or more of the raised elements of the omnidirectional relief pattern. Therefore, when a siding or cladding panel is overlapped with an adjacent siding or cladding panel, the omnidirectional relief pattern on the back side of the upper siding panel aligns with the securing hole on the exterior surface of the lower siding panel.

In the preferred embodiment, siding 110, 210, 262, 322, 372, is fabricated from a cement board or similar fiber-cement composite. In one example of fabrication, the raised features, such as raised elements 112, 212, 228, 312, 328, formed on siding 110, 210, 262, 322, 372 are formed using an embossing processes. Alternatively, siding 110, 210, 262, 322, 372 may be fabricated from any material know in the industry that may benefit from ventilation and moisture drainage between siding and a structure to which it is secured.

Raised features may be a bump or dot pattern similar to that shown in FIGS. 1, 2A, 3A, 4A, 5, 7, 8, 9, 10, 11A and 12. Alternatively, the raised elements may be continuous, for example in an egg-crate pattern, similar to that shown in FIGS. 2B, 3B, 4B, 6, and 11B. Other patterns that facilitate drainage may be used without departing from the scope herein.

In an alternative embodiment, siding, similar to siding 210, 262, may be fabricated to include, within a series of recesses (not shown) at the lower portion of its back surface, a moisture reactive material (not shown), one example of which is bentonite. In the situation where moisture contacts the moisture reactive material, the material expands thereby pushing the lower portion 216, 236 of siding 210, 262 away from the upper portion 217, 237 of the next lowest siding 210, 262. This process creates a drainage channel at location 218, 238 during wet conditions and closes the drainage channel during dry conditions. In this configuration, siding 210, 262 is formed of, with, or includes a semi flexible material, such that the expansion of the moisture reactive material does not fatigue or otherwise damage the siding.

Figure 3A:
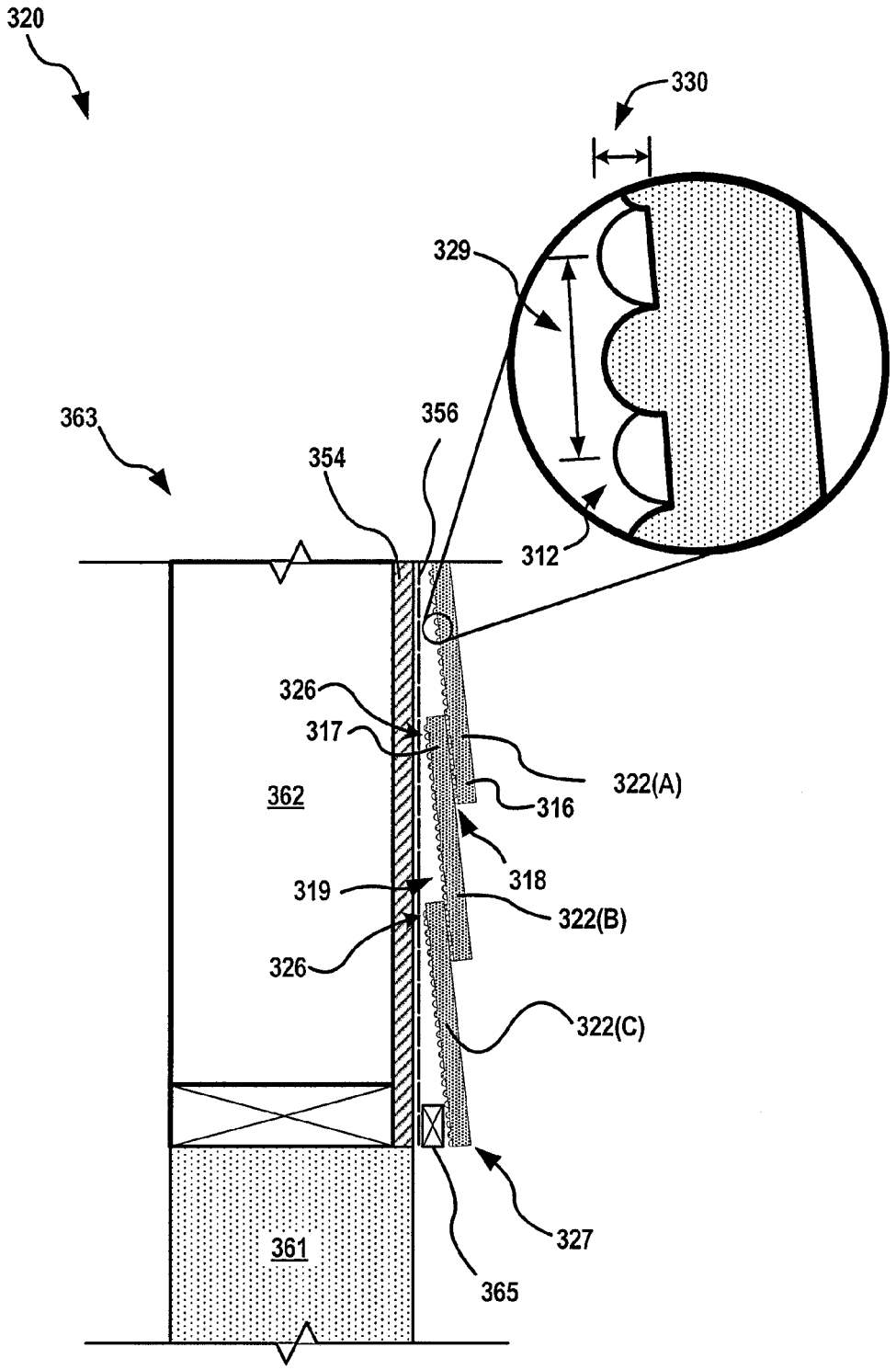
FIG. 3A is a side view of a water control siding utilizing a raised pattern of bumps or dots on its entire back surface, including at areas of overlapping siding, which provides a ventilation and drainage space behind the siding and from the back of the siding to its front, in an embodiment.

FIG. 3A shows a close-up of a system 320, formed of a plurality of siding 322(A)-(C) secured to a structure 363 formed with a weather resistant barrier 356 and a sheathing 354 fixed to a frame 362 that is set on a foundation 361. Frame 362 includes a starter strip 365 for spacing the lower edge of the lowest siding 322(C) away from frame 362. In FIG. 3A, raised features 328 are formed as a raised three-dimensional or egg-crate pattern, similar to FIG. 2A, except raised elements 328 cover the entirety of the back surface of siding 322(A)-(C). Each siding 322 includes raised elements 312 formed on the entire back (unexposed) surface. Raised elements 312 may be formed with a height 330 of ⅛ of an inch and a peak to peak separation distance 329 of about ½ of an inch. As disclosed above, raised elements space siding 322 away from structure 363, thereby generating ventilation and drainage plane 319.

In the embodiment of FIG. 3A, a bottom portion 316 of siding 322(A) overlaps a top portion 317 of the next lowest siding, siding 322(B). Such a configuration provides ventilation to drainage plane 319 and a water and water vapor egress from drainage plane 319 at a location 384. Additionally, moisture may migrate between siding 322(A)-(C) and structure 363 via drainage channels 326.

In an embodiment, starter strip 365 is formed with raised elements (not shown) similar to raised elements 328 to act an additional egress for water or water vapor and to increase ventilation.

Figure 3B:
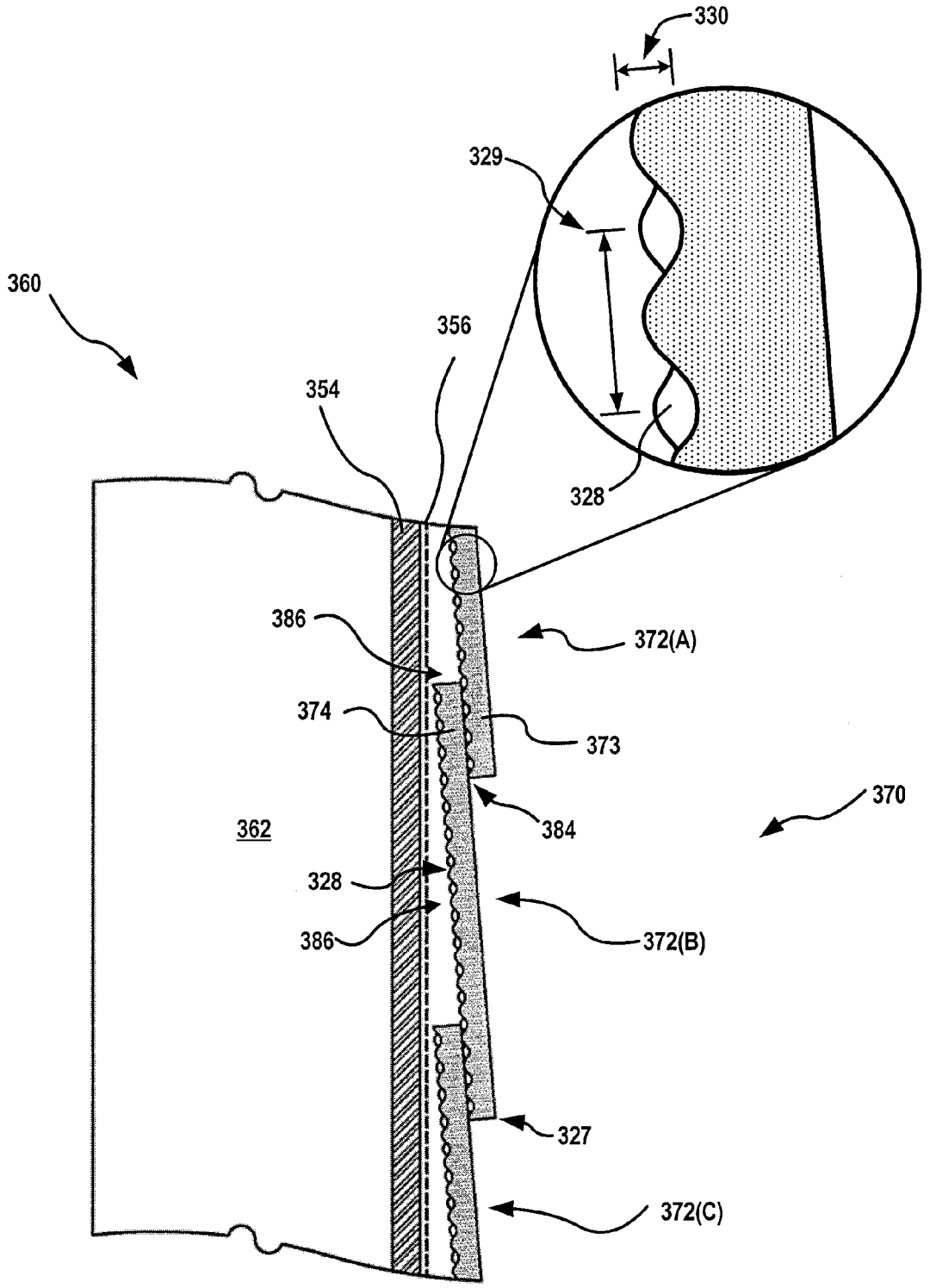
FIG. 3B is a side view of a water control siding utilizing an egg-crate or other three-dimensional pattern on its entire back surface, which provides a ventilation and drainage space behind the siding and from the back of the siding to its front, in an embodiment.

FIG. 3B shows a close-up of a system 370, formed of a plurality of siding 372 secured to a structure 360 having weather resistant barrier 356, sheathing 354, and frame 362. In FIG. 3B, raised features 328 are formed as a raised three-dimensional or egg-crate pattern, similar to FIG. 2B, except raised elements 328 cover the entirety of the back surface of siding 373. In the embodiment of FIG. 3B, a bottom portion 373 of each siding 372(A) overlaps a top portion 374 of the next lowest siding, siding 372(B). Such a configuration provides a front vent at location 384 which provides an inlet for air and an exit for moisture. Additionally, moisture may migrate between siding 372 and structure 360 via drainage channels 386.

Figure 4A:
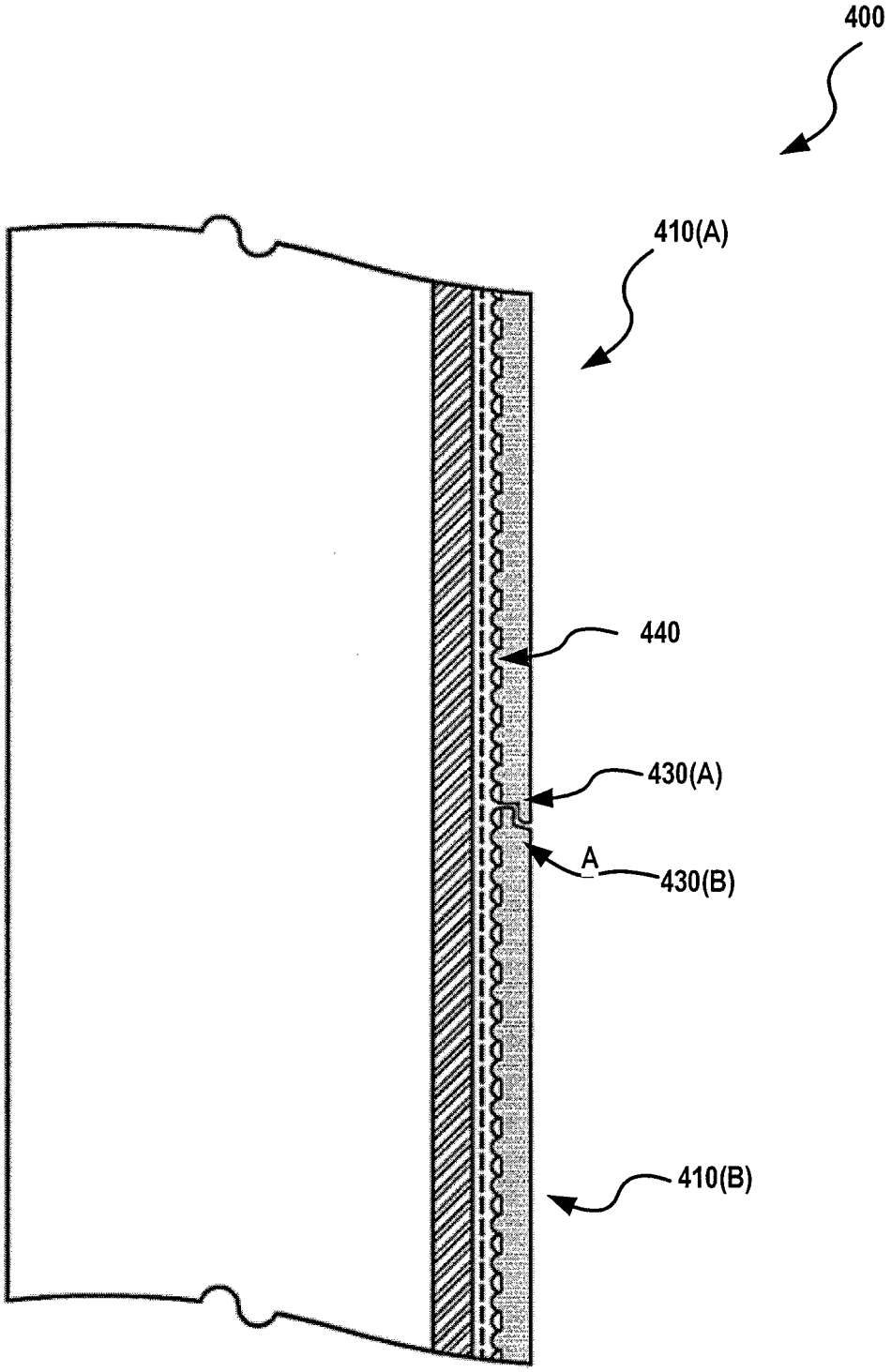
FIG. 4A is a side view of co-planar water control siding utilizing a pattern of bumps or dots on its back surface and secured to a structure, in an embodiment.

In an alternative embodiment, shown in FIG. 4A, siding 410(A) and 410 (B) are formed with overlapping structures 430(A) and 430(B) and having dot patterned raised elements 440 similar to raised elements 212. Overlapping structure 430(A) overlaps overlapping structure 430(B) such that siding 410(A) and siding 410(B) are substantially in the same plane. In addition, overlapping structure 430(A) and 430(B) may also be utilized as alignment features for aligning siding 410(A) with siding 410(B). It will be understood that vented and water control sheathing may utilize the same or similar overlapping structures to the same benefit.

Figure 4B:
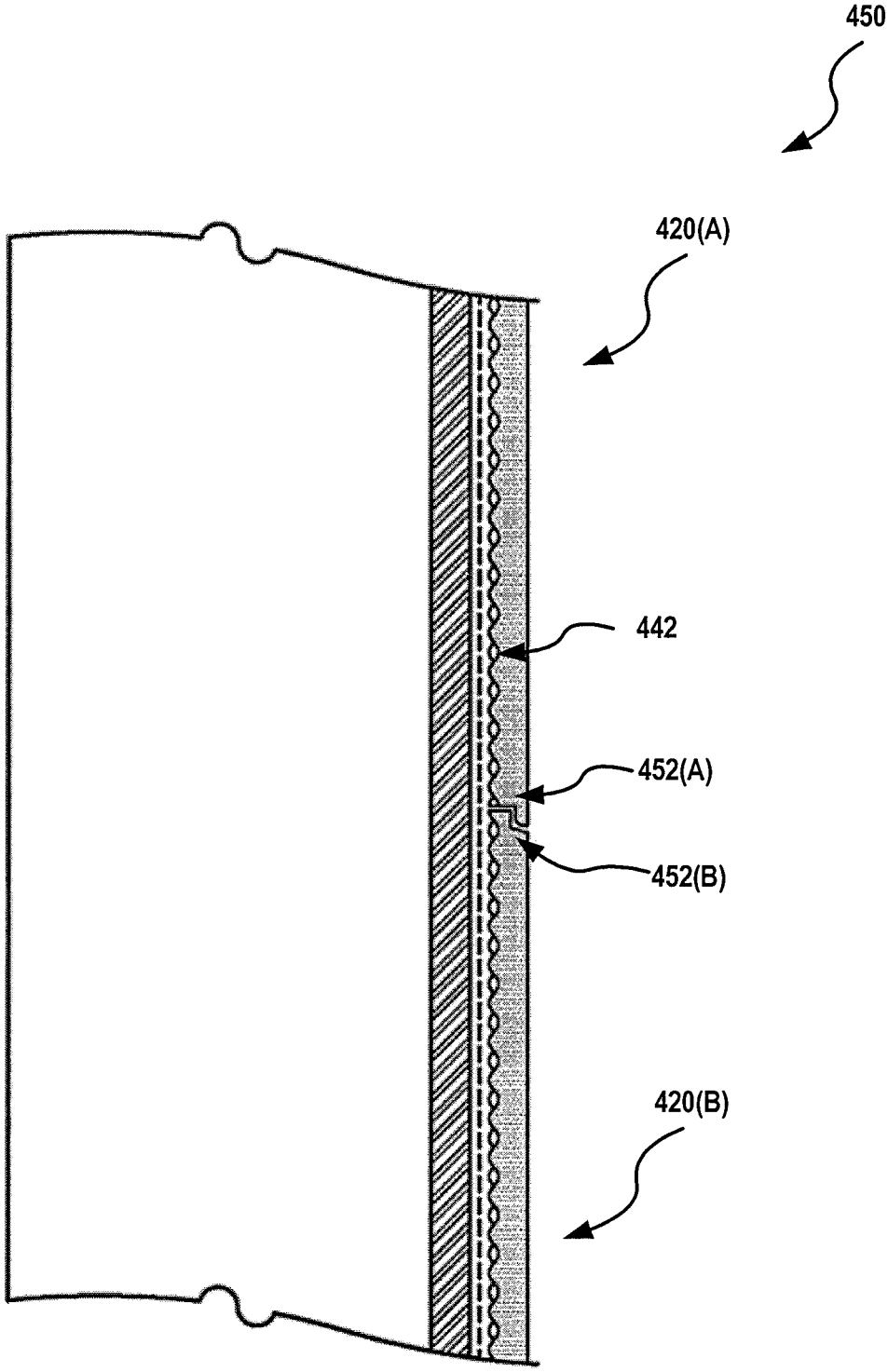
FIG. 4B is a side view of co-planar water control siding utilizing an egg-crate or other three-dimensional pattern and secured to a structure, in an embodiment.

In another alternative embodiment, shown in FIG. 4B, siding 420(*a*) and 420(*b*) are formed with overlapping structures 452(A) and 452(B) and having egg-crate patterned raised elements 442 similar to raised elements 228 of FIG. 2B. Overlapping structure 452(A) overlaps overlapping structure 452(B) such that siding 420(A) and siding 420(B) are substantially in the same plane. In addition, overlapping structure 452(A) and 452(B) may also be utilized as alignment features for aligning siding 420(A) with siding 420(B). It will be understood that vented and water control sheathing may utilize the same or similar overlapping structures to the same benefit.

Figure 5:
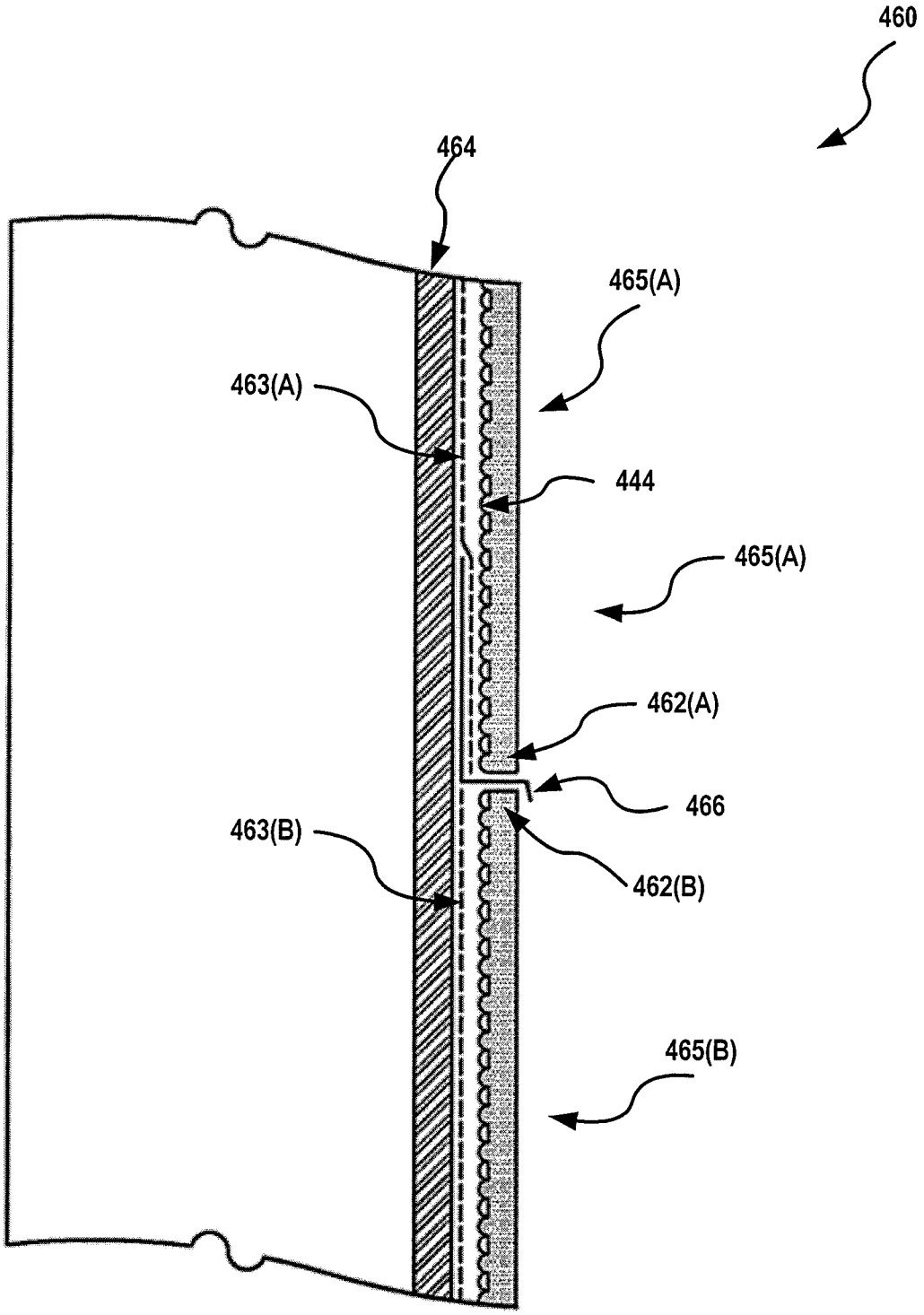
FIG. 5 is a side view of co-planar water control siding utilizing a raised pattern of bumps or dots, with flashing located in a butt joint formed at the joint between two sidings, and secured to a structure, in an embodiment.

In another embodiment, shown in FIG. 5, vented and water control siding 465(A) and 465(B) are formed with substantially flat surfaces 462(A), 462(B) and having dot patterned raised elements 442 similar to raised elements 440 of FIG. 4(A). Siding 465(A), 465(B) are butt jointed with a flashing 466 therebetween such that siding 465(A) and 465(B) are substantially in the same plane. Flashing 466 is secured to a sheathing 464, for example by nails or screws (not shown), with a weather resistant barrier 463(A) overlaid on top of the upper portion of flashing 466. This configuration provides a path of egress for moisture trapped between weather resistant barrier 463(A) and siding 465(A) via flashing 466 at the butt joint. It will be understood that vented and water control sheathing may utilize the same or similar overlapping structures to the same benefit.

Figure 6:
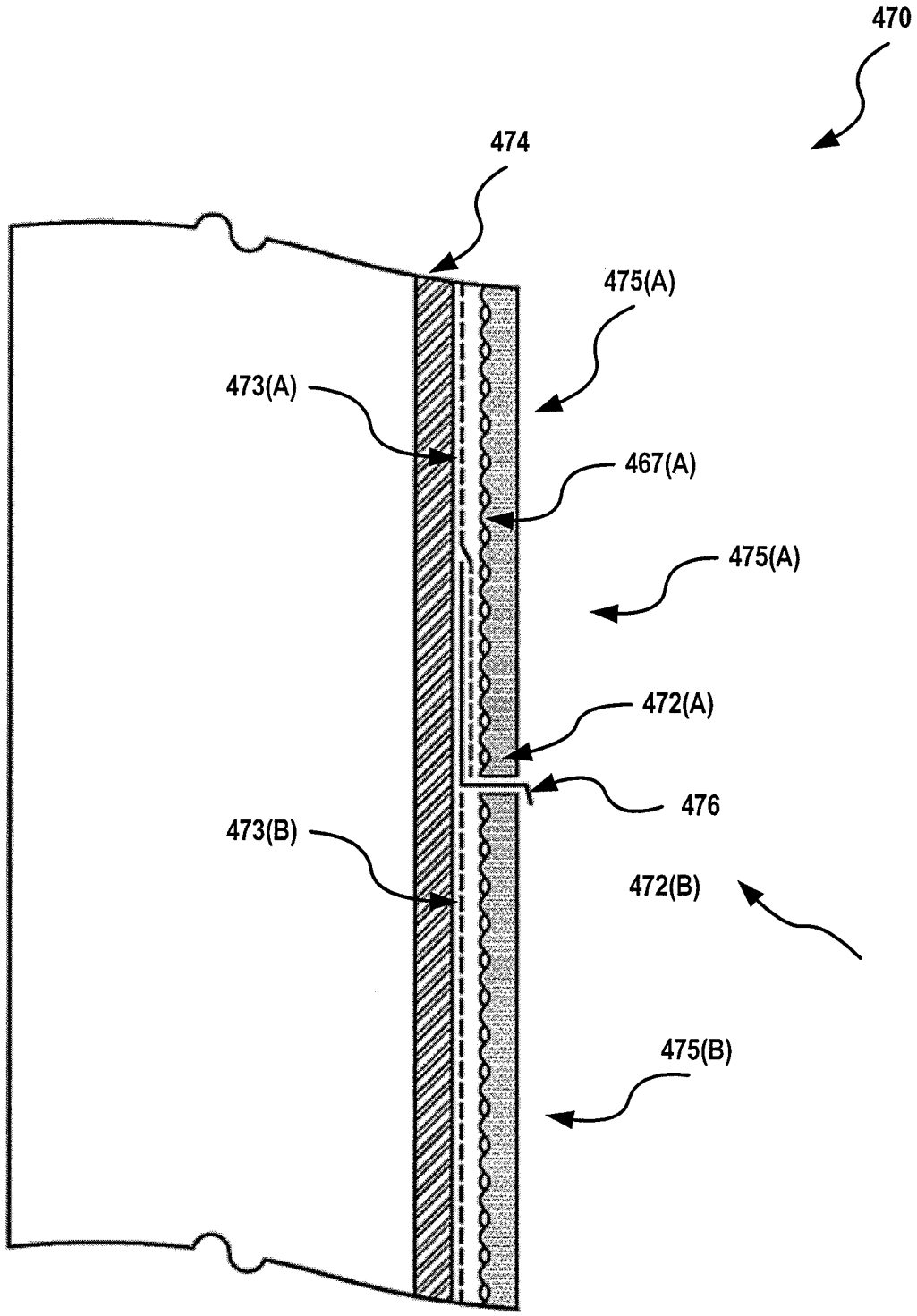
FIG. 6 is a side view of co-planar water control siding utilizing an egg-crate or other three-dimensional pattern, with flashing located in a butt joint formed at the joint between two sidings, and secured to a structure, in an embodiment.

In another embodiment, shown in FIG. 6, vented and water control siding 475(A) and 475(B) are formed with substantially flat surfaces 472(A), 472(B) and having egg-crate patterned raised elements 467 similar to raised elements 442 of FIG. 4(B). Siding 475(A), 475(B) join at a butt joint with a flashing 476 therebetween such that siding 475(A) and 475 (B) are substantially in the same plane. Flashing 476 is secured to a sheathing 474, for example by nails or screws (not shown), with a weather resistant barrier 473(A) overlaid on top of the upper portion of flashing 476. This configuration provides a path of egress for moisture trapped between weather resistant barrier 473(A) and siding 475(A) via flashing 476 at the butt joint. It will be understood that vented and water control sheathing may utilize the same or similar overlapping structures to the same benefit.

Patterned Panels

It will be understood that panels may be fabricated from any number of materials that accepts a pattern, for example, by embossing or patterning, such as Oriented Strand Board (OSB), cement board, fiber-cements board, Medium Density Fiberboard (MDF), Gypsum sheathing, insulation, foam insulation, or any other material. Even though the present invention is suitable for use with any of many products, the invention will be disclosed in the context of OSB sheathing from this point forward.

Figure 7:
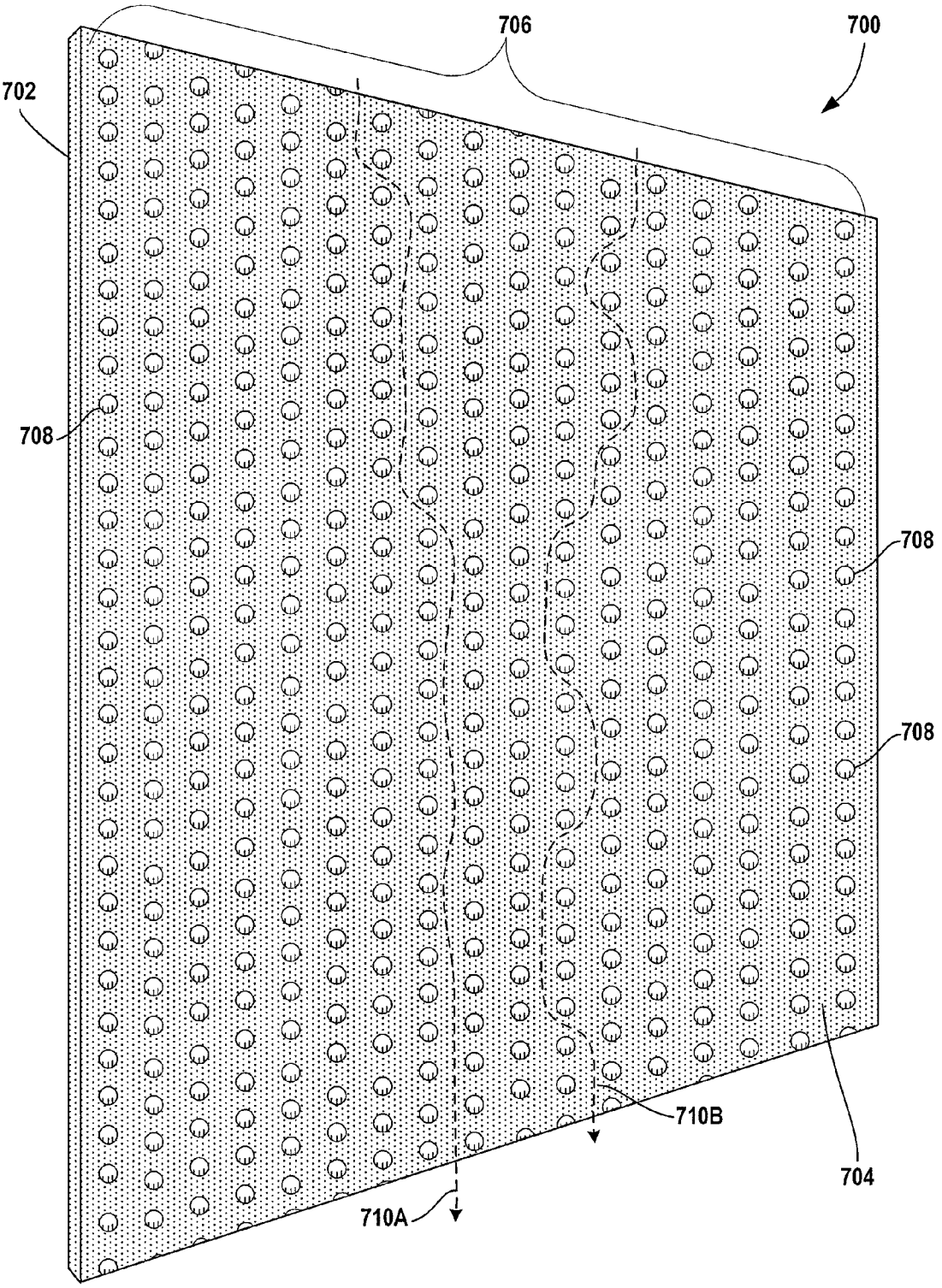
FIG. 7 is a perspective front view of a panel of vented and water control sheathing utilizing a raised pattern of bumps or dots, according to an embodiment.

FIG. 7 shows a panel 702 of water control OSB sheathing 700. Panel 702 is made of cross-directional strips or strands of wood, and is not limited to any particular type of wood or size of strip/strand. A front or outer face 704 includes a non-directional grid or pattern 706 of raised surface features 708. Other patterns may be used, for example an egg-crate pattern similar to egg-crate pattern shown in FIG. 3B, without departing from the scope herein. A plurality of drainage and ventilation channels 710, indicated by dashed lines, are formed between raised surface features 708. It will be appreciated that although only two channels 710A and 710B are shown, air or moisture is not limited to the particular paths shown between surface features 708. A lower/inner face 712 opposite outer face 704 (see FIG. 8) may be flat, in order to facilitate attachment with the frame of a building. The non-directional nature of pattern 706 allows a user to cut and hang OSB sheathing 700 at any desired orientation without sacrificing drainage or ventilation, as channels 710 through surface features 708 exist between outer face 704 and an exterior finish (e.g. siding or cladding) regardless of how panel 700 may be rotated within a vertical plane. Exterior finish may also be roofing materials, such as shingles, as discussed below with reference to FIG. 18. Likewise, channels 710 allow for circulation and/or drainage whether panel 700 is hung vertically or at an angle.

Figure 8:
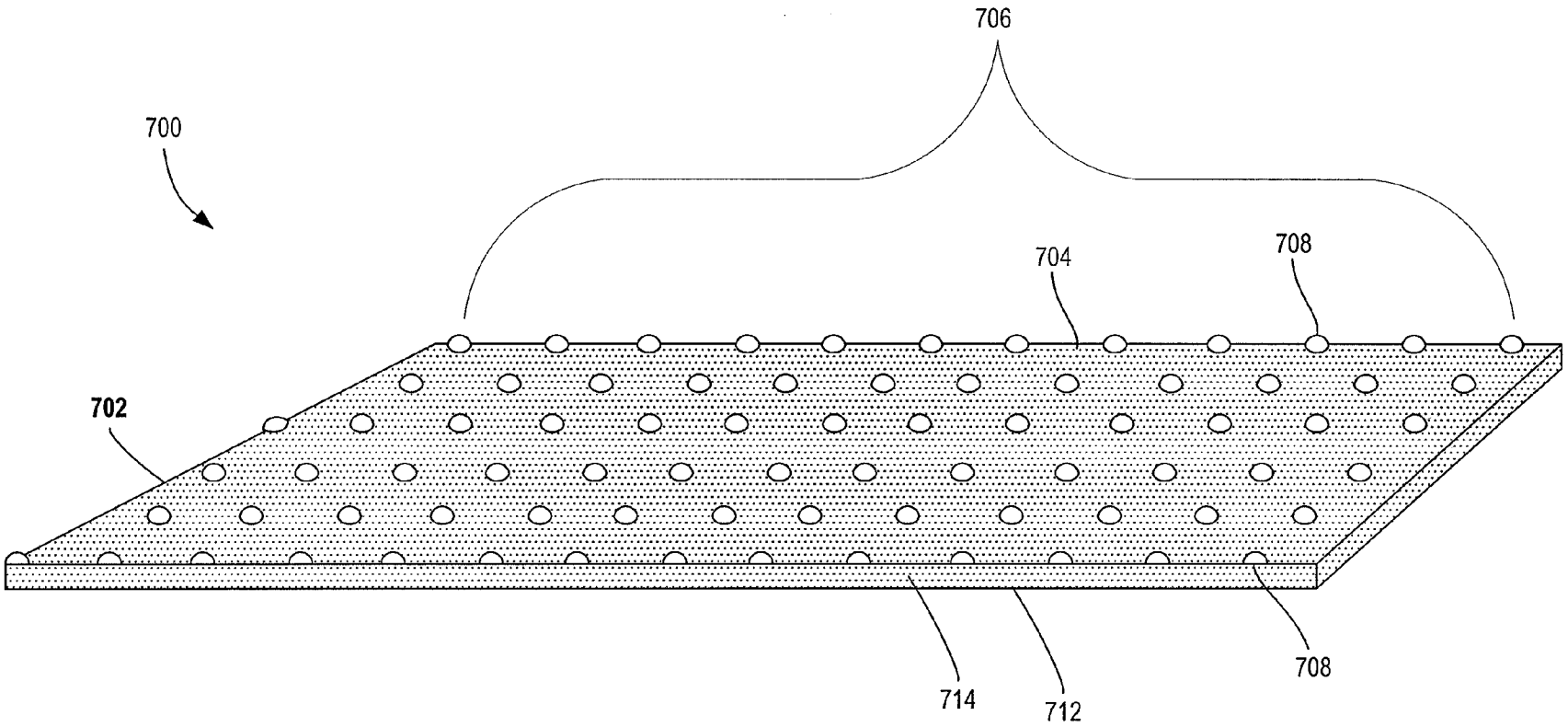
FIG. 8 is a perspective side/end view of the panel of FIG. 7.
Figure 9:
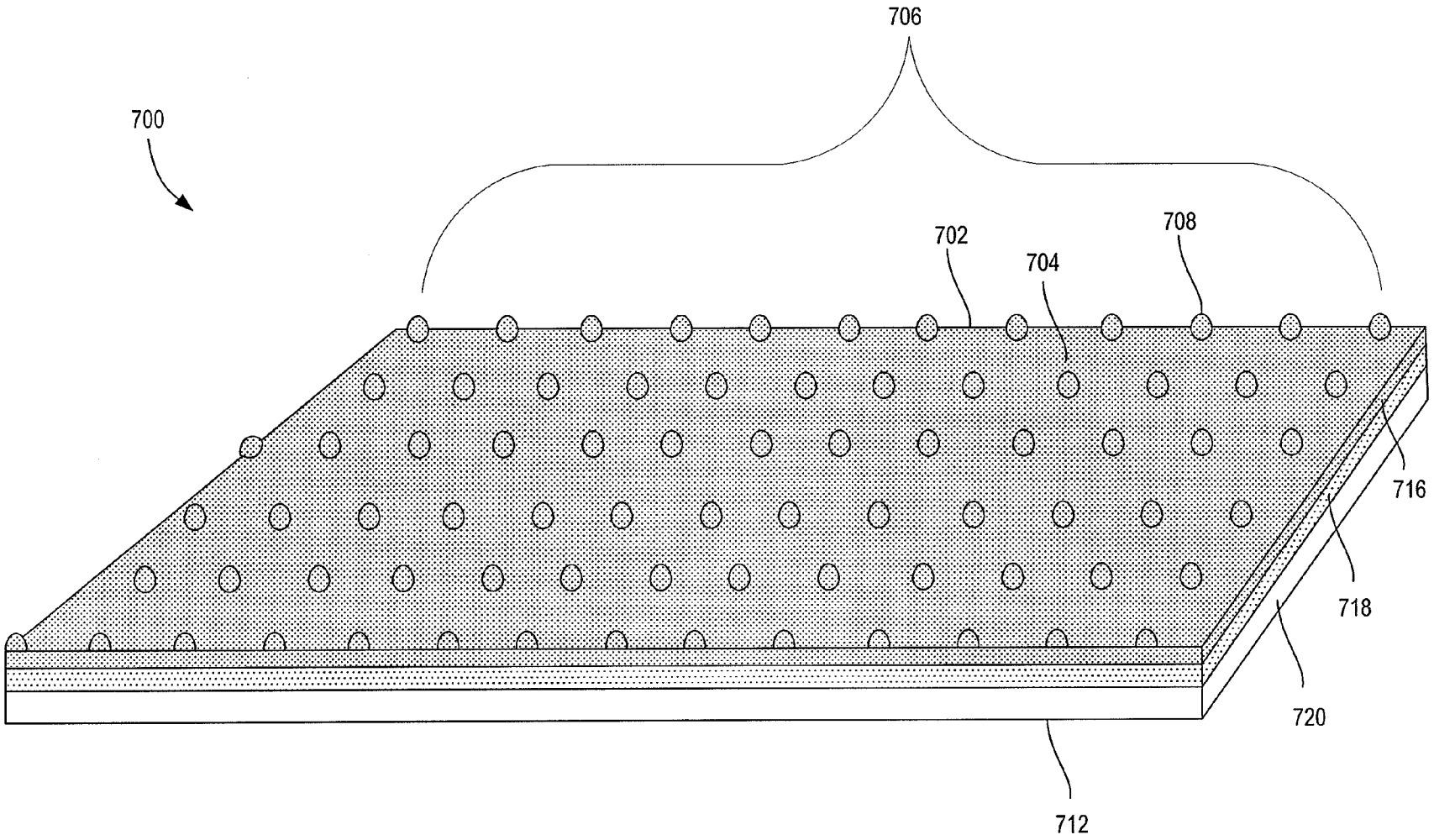
FIG. 9 is a perspective side/end view of a panel of vented and water control sheathing, according to an embodiment.
Figure 10:
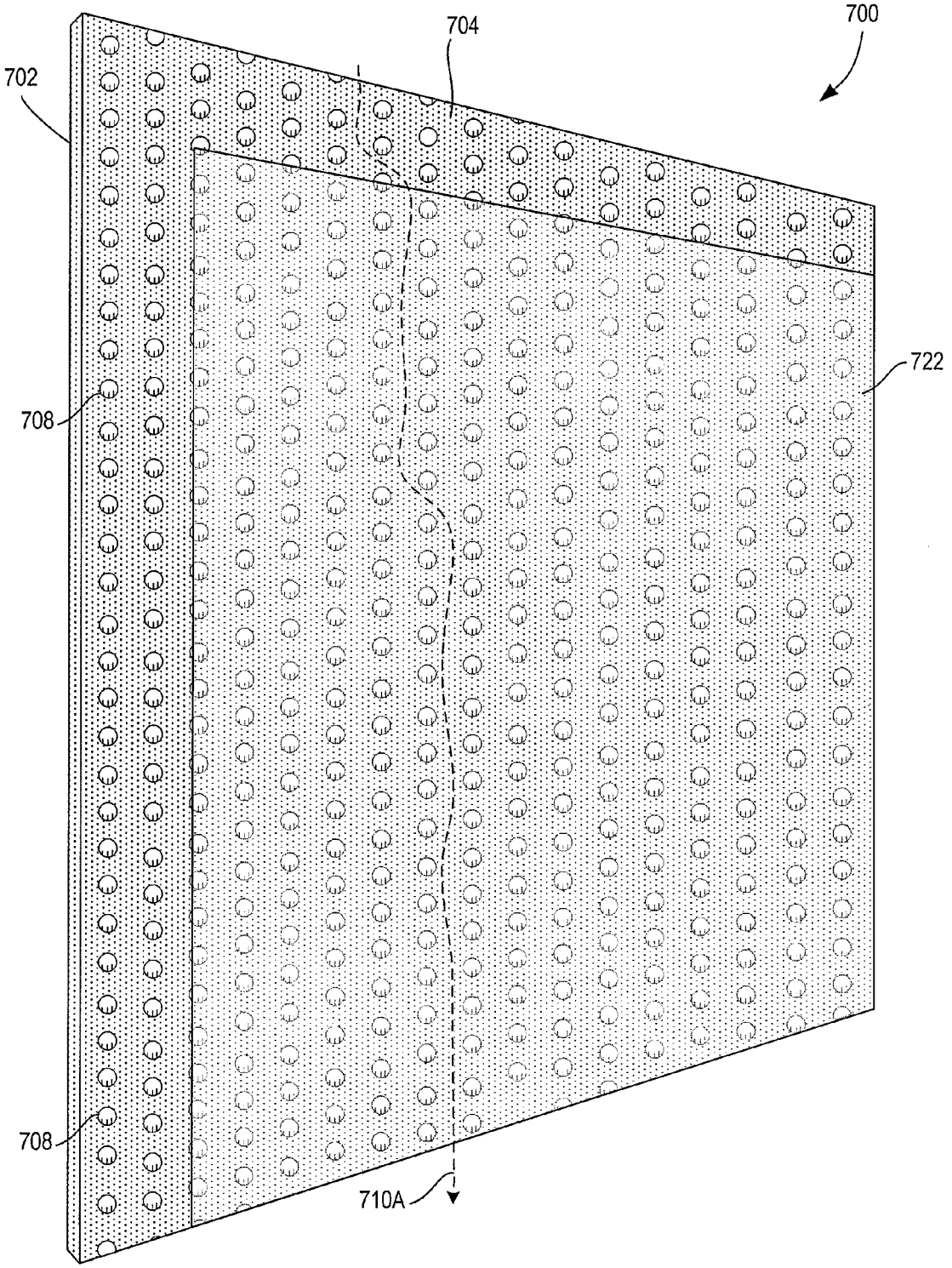
FIG. 10 is a perspective front view of the panel of FIG. 7 including an applied water barrier, according to an embodiment.

As shown in FIG. 8, panel 702 includes a core 714 between outer and inner faces 704 and 712. Panel 702 may be formed of a uniform strip/strand size, or panel 702 may incorporate a variety of strand sizes. In one aspect, as shown in FIGS. 9 and 11, a core may be stratified such that an outer layer or portion 716, the outer face of which is face 704, is formed of finer (i.e., smaller) wood strands than the remainder of the core. FIGS. 9 and 11 illustrate three layers 716, 718 and 720 forming the core. Layer 720 is formed of the largest strands; layer 718 is formed of finer strands, and layer 716 is formed of still finer strands. It will be appreciated that although a three-layer the core is shown, this is for illustrative purposes only. More or fewer layers may be included in the core; furthermore, layers may not be sharply defined as illustrated, but rather may flow into one another in gradient fashion.

Figure 11A:
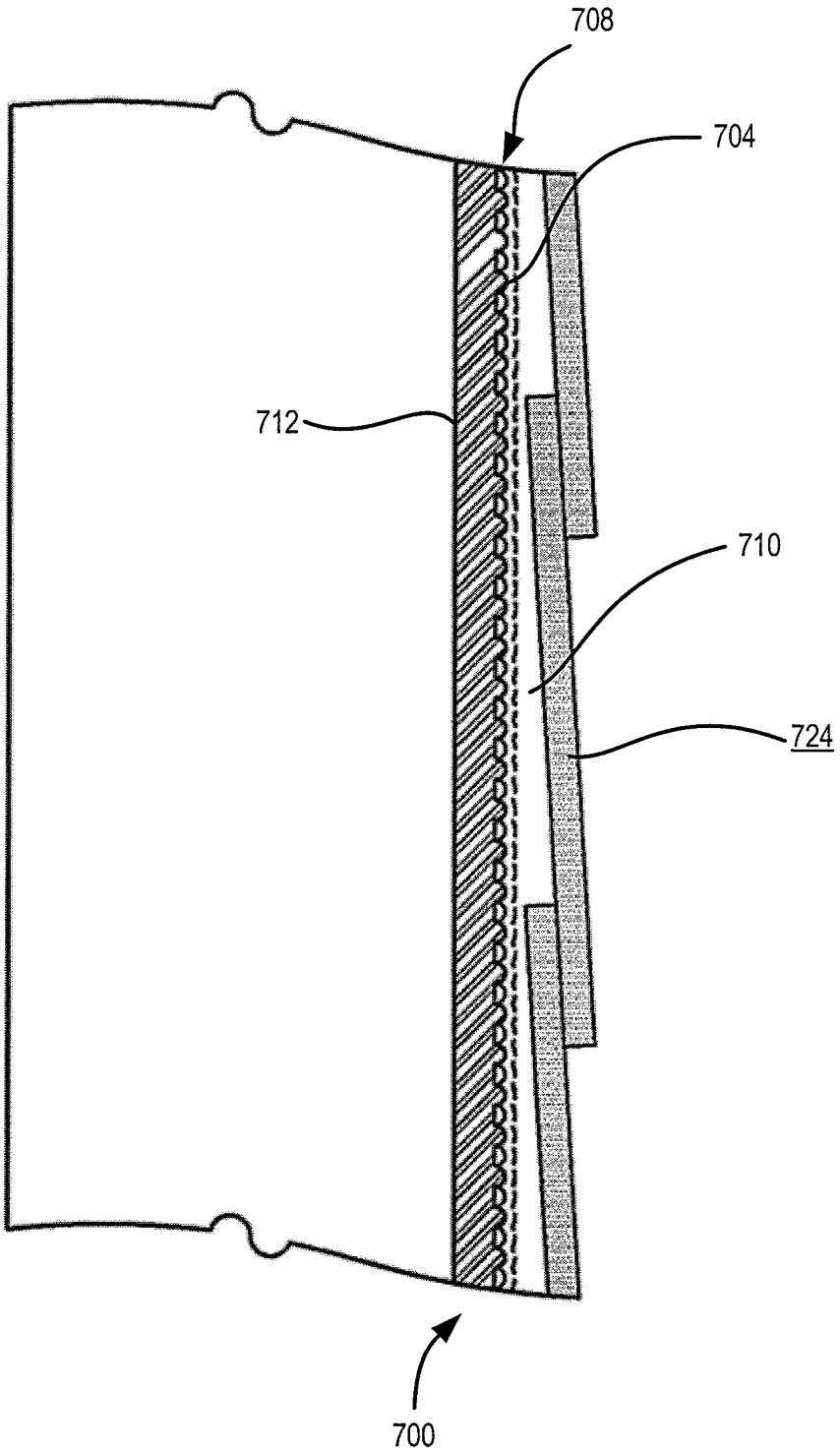
FIG. 11A is a side view of the panel of FIG. 10, attached with an exterior finish or cladding, according to an embodiment.
Figure 11B:
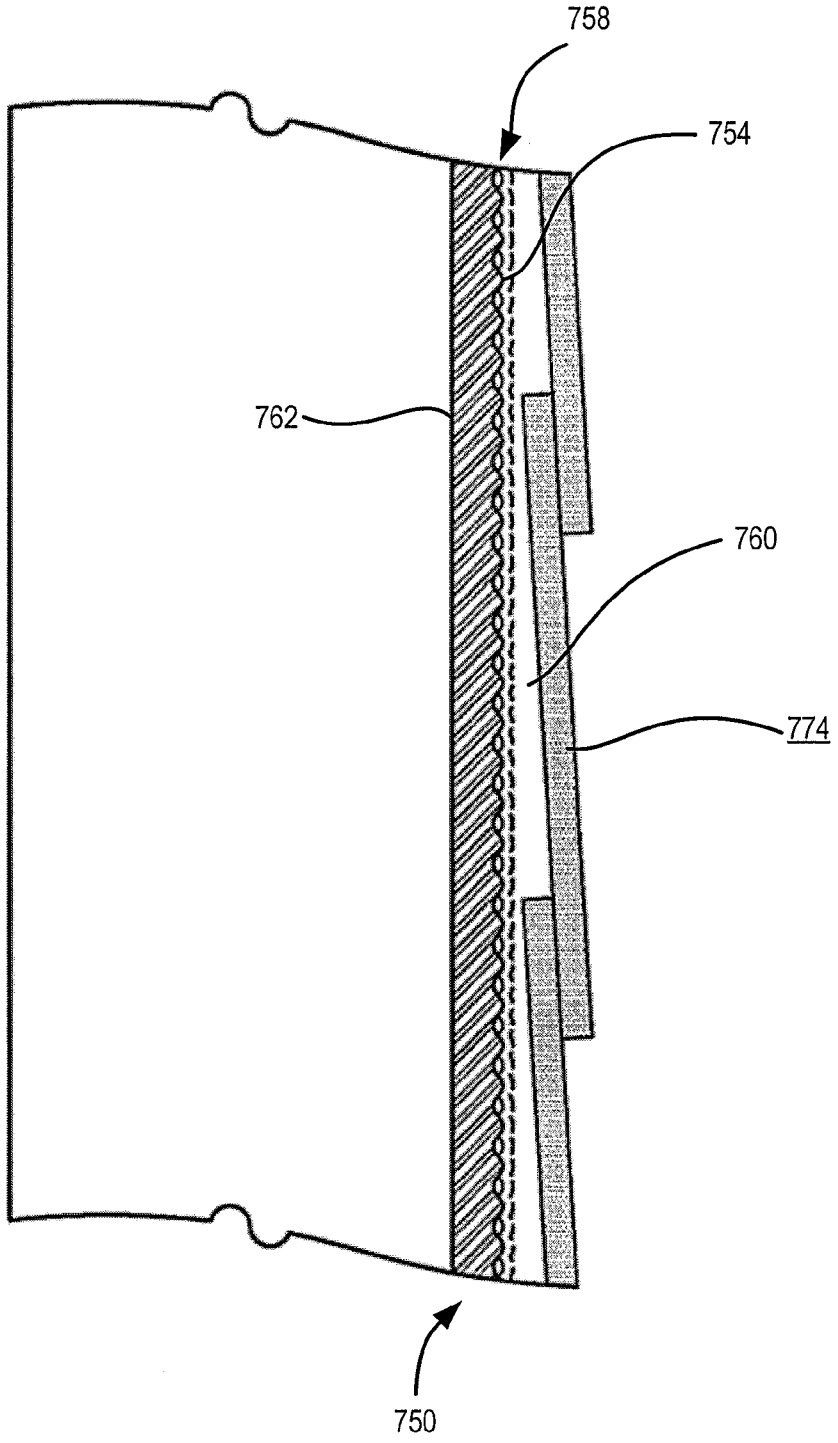
FIG. 11B is a side view of a panel of vented and water control sheathing utilizing an egg-crate or other three-dimensional pattern, attached with an exterior finish or cladding, according to an embodiment.
Figure 12:
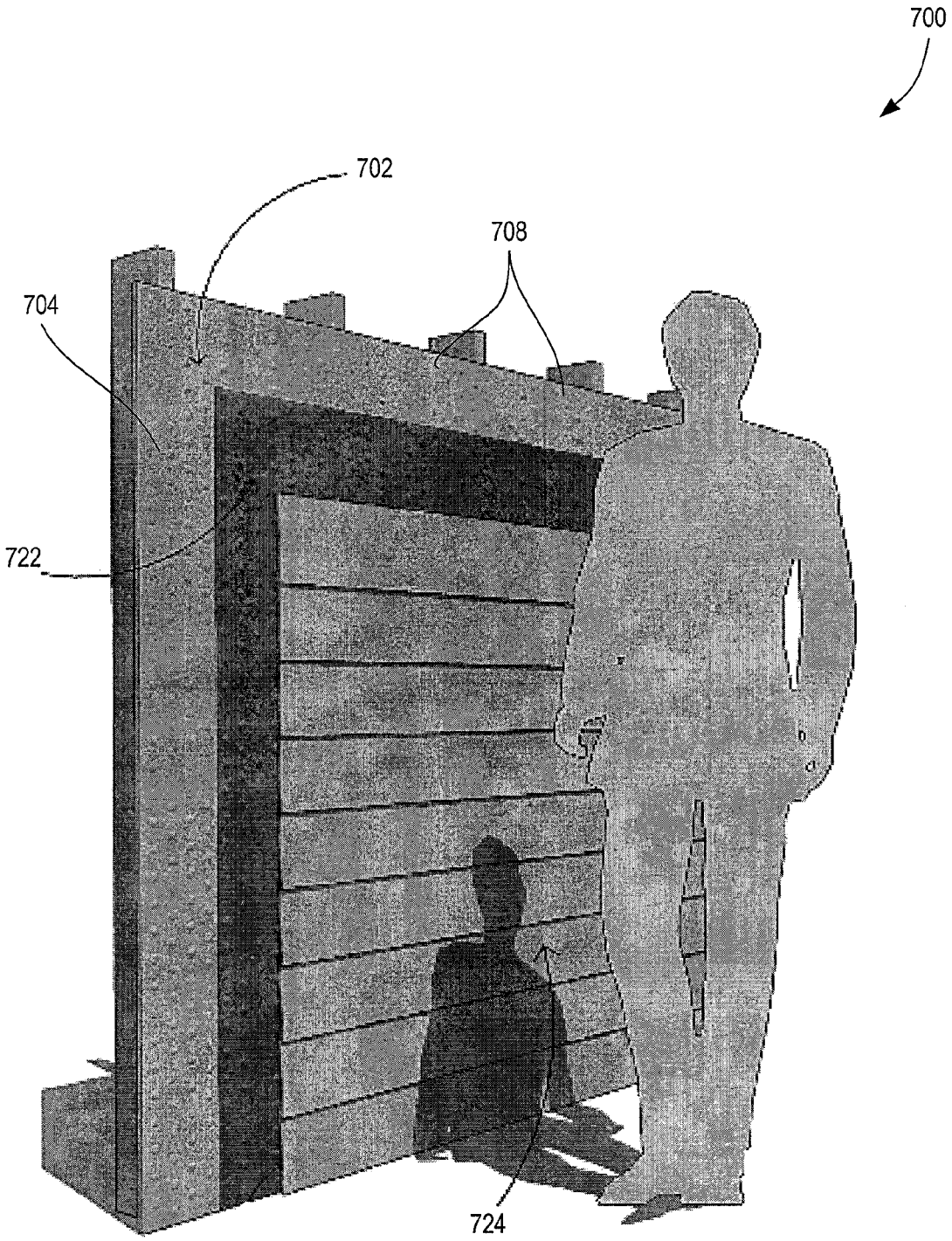
FIG. 12 is a perspective front view of a panel of vented and water control sheathing attached with a building frame, including a water barrier and attached with an exterior finish, according to an embodiment.

Fine wood strands of upper layer 716 facilitate stamping or embossing surface features 708 into outer face 704, as further described with respect to FIG. 13, below. As illustrated in FIGS. 11(A) and (B), surface features 708, 758 provide connection points for attaching an exterior finish, such as siding or cladding, (shown as siding 724, 774, although OSB sheathing 700, 750 is not limited to use with siding) to OSB sheathing 700, 750. Surface features 708, 758 further provide an offset between face 704, 754 and a back surface of siding 724, 774, thus creating ventilation and/or drainage channels 710, 760 between siding 724, 774 and OSB sheathing 700, 750. Channels 710, 760 beneficially allow for air to circulate beneath siding 724, 774 or other exterior finish, such as siding or cladding, allowing the OSB sheathing and siding to breathe, thus reducing condensation or other moisture buildup. In addition, channels 710, 760 allow any moisture deposited between the finish and the OSB sheathing to drain to the ground. Vented and water control OSB sheathing 700, 750 thereby reduces or eliminates problems such as edge swelling, mold and other moisture related problems. It will be appreciated that seams between panels 712, 762 may require treatment with sealant tape, or other moisture barrier, as is known in the art.

Sheathing 700 may also be formed from other materials including, but not limited to, fiber reinforced cement, gypsum, paper backed gypsum, insulation, foam insulation, wood, metal, or other materials. For example, in one embodiment, a foam panel is press molded one surface to include features (similar to features 708). Upon insulation, the features are installed facing exteriorly from the structure to provide an omnidirectional drainage and ventilation path for moisture and air between the sheathing and attached siding, cladding, or trim-board.

Sheathing 700 may also include other features discussed herein. For example, sheathing 700 may include overlapping structures (such as structures 430(A) and 430(B), and 452(A) and 452(B), discussed above) such that adjacent panels of sheathing 700 overlap and are substantially in the same plane when installed. Alternatively, sheathing 700 may be butt jointed with adjacent sheathing panels and include flashing (such as flashing 466) therebetween such that adjacent sheathing panels are substantially in the same plane when installed. In addition, sheathing 700 may include an omnidirectional relief pattern on both a front and back side. By including omnidirectional relief pattern on both sides, sheathing 700 will provide an omnidirectional drainage and ventilation path on the exterior facing side. Also, the interior facing side will reduce thermal bridging where the panel meets the stud. Thus, the omnidirectional relief pattern on the internal sidew ill increase the energy efficiency of the structure, particularly where steel studs are used in the construction of the structure.

A water-resistant barrier 722 (FIGS. 10 and 12) may be applied to outer face 704 and surface features 708. In one aspect, water-resistant barrier 722 is a hydrophobic barrier and is applied as a fluid membrane. Barrier 722 may therefore be spray-coated, painted or rolled onto outer face 704 and surface features 708, or panel 702 may be dipped into liquid barrier 722. In another aspect, barrier 722 is applied to outer face 704 prior to stamping or embossing panel 702 with surface features 708.

Figure 13:
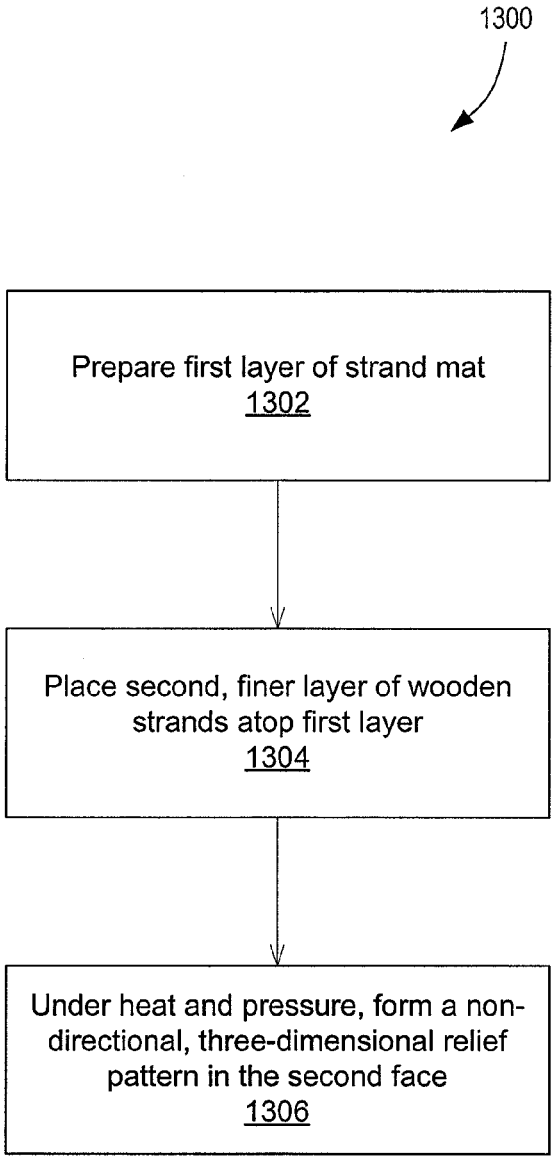
FIG. 13 is a flowchart illustrating a method of manufacturing vented and water control sheathing, according to an embodiment.

FIG. 13 illustrates one method 1300 for manufacturing water control OSB sheathing. A first, lower/inner layer of a wood strands is prepared, in step 1302. A second, finer layer of wooden strands is placed atop the first layer, in step 1304. In one aspect, the second, finer layer is machine-positioned atop the first layer, which is also applied (i.e., to a conveyor belt or other platform) by machine. The strand mat is subjected to heat and pressure, and an omnidirectional relief pattern is formed in the second, outer face, in step 1306. In one aspect, pattern 706 is formed in face 704. The OSB panel formed via method 1300 may be coated with a water resistant barrier, either before or after forming the omnidirectional relief pattern in the outer face. In alternate embodiments, sheathing, siding, trim-board, or cladding may be formed as stamped, embossed, or otherwise formed with a raised surface omnidirectional pattern that provides an air space for ventilation and a drainage plane.

Figure 18:
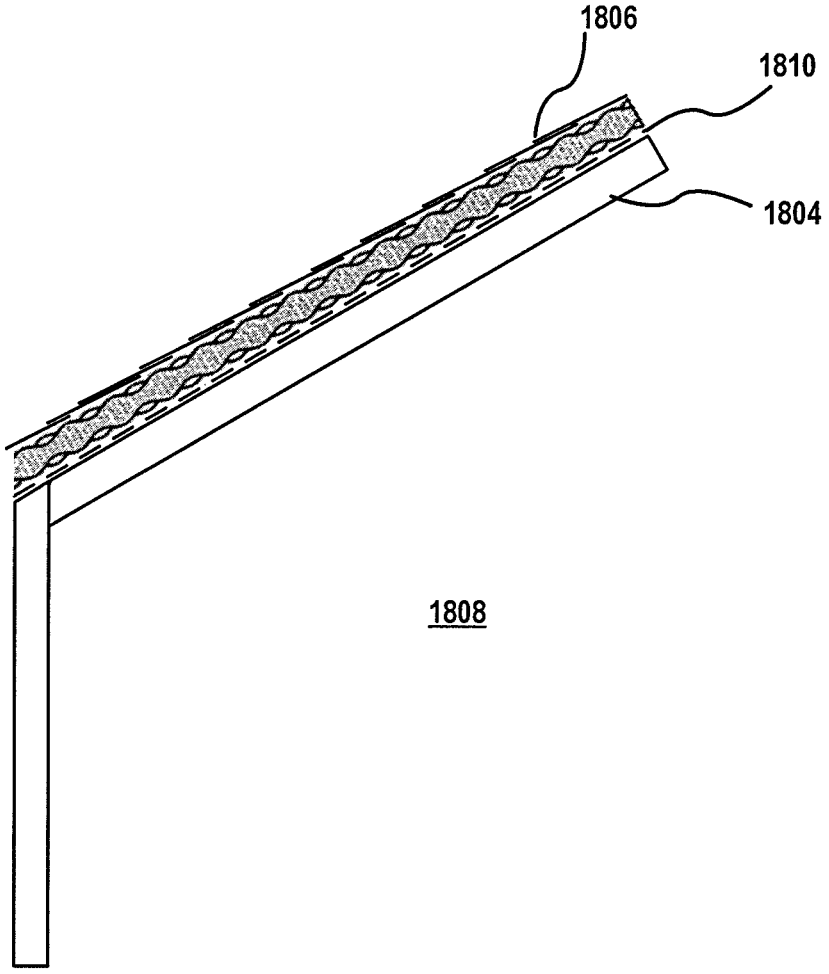
FIG. 18 depicts sheathing when utilized as roof sheathing and installed on rafters of structure, in one embodiment.

FIG. 18 depicts sheathing 1802 when utilized as a roof sheathing and installed on rafters 1804 of structure 1800, in one embodiment. Sheathing 1802 includes an omnidirectional relief pattern on each side of sheathing 1802. The omnidirectional relief pattern may be a grid pattern of raised bumps as discussed above (e.g. raised dots, egg crate pattern, or raised elements such as a pyramids, squares, rectangles, etc.). The pattern on the outer surface provides an omnidirectional drainage and ventilation path between sheathing 1802 and roofing shingles 1806. Furthermore, the omnidirectional relief pattern on the exterior surface provides a non-slip surface during installation or maintenance of the roof. The pattern on the inner surface provides ventilation path between an interior space 1808 and the exterior of the structure. Roof ventilation is a code requirement when ceilings are attached to the roof rafters or framing below. Weather resistant barrier 1810 may be included between sheathing 1802 and rafters 1804, or also between sheathing 1802 and shingles 1806, or both.

Figure 14A:
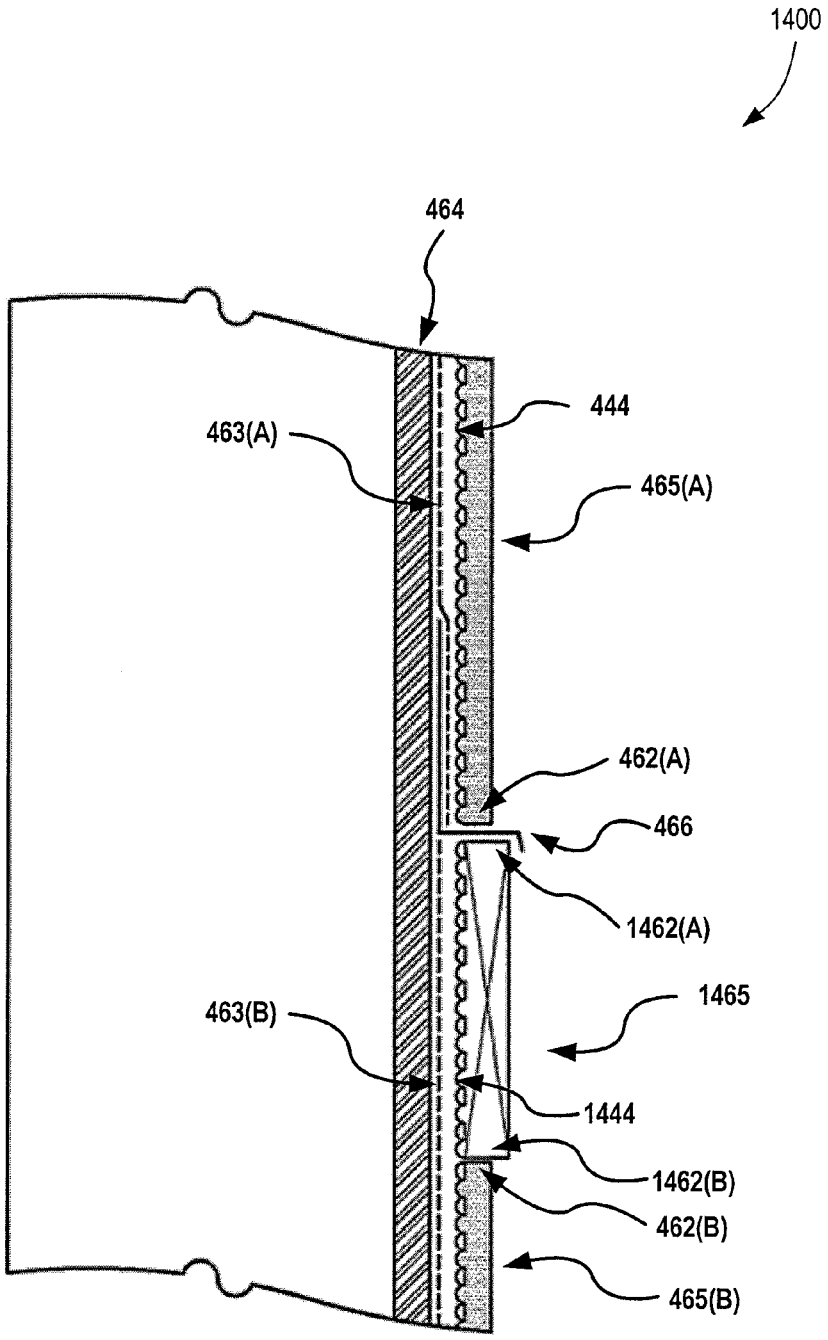
FIG. 14A is a side view of a vented and water control trim-board/molding utilizing a raised pattern of bumps or dots and secured to a structure, according to an embodiment.

Patterned Trim-Board/Molding:

FIG. 14A shows a side view of one exemplary vented and water control trim-board/moldings 1465 secured to a structure, similar to the structure shown in FIG. 5. In the examples of FIG. 14(A), trim-board/molding 1465 is butt jointed with siding 465(A), 465(B) with flashing 466 positioned between flat surface 462(A) and a substantially flat surface 1462(A) of trim-board/molding 1465 such that trim-board/molding 1465 is substantially in the same plane as siding 465(A), 465(B). Flashing 466 is secured to a sheathing 464, for example by nails or screws (not shown), with a weather resistant barrier 463(A) overlaid on top of the upper portion of flashing 466. It will be understood that other methods of joining trim-board/molding 1465 with a siding may be utilized without departing from the scope herein, examples of which include but not limited to, lap joint, overlay, etc.

The disclosed trim-board/molding provides ventilation and water control by providing a raised pattern on the inward facing surface of the trim-board/molding. Examples of a pattern utilized on the trim-board/molding is a pattern of raised bumps/dots 1444 as shown FIG. 14A. This pattern is merely an example of a structure that facilitates ventilation and water control, and is not meant to limit the type, design, size, or configuration of the ventilation and water control raised pattern. In the embodiment of FIG. 14A, the raised pattern is integrally manufactured into the trim-board/molding product. The water control trim-board/molding may, for example, be stamped, embossed, or otherwise formed with a raised surface omnidirectional pattern that provides an air space for ventilation and a drainage plane between the sheathing 464 and the trim-board/molding 1465. The omnidirectional nature of patterns 1444 allows trim-board/molding 1465 to be installed in any orientation without affecting the ventilation and water control properties.

Water control trim-board/molding 1465 may be manufactured using a number of different materials, examples of which include but are not limited to, fiber cement, hardboard, OSB, PVC, wood fiber/resin composite, gypsum, foam, foam insulation, and glass fiber reinforced plastic composite.

Figure 14B:
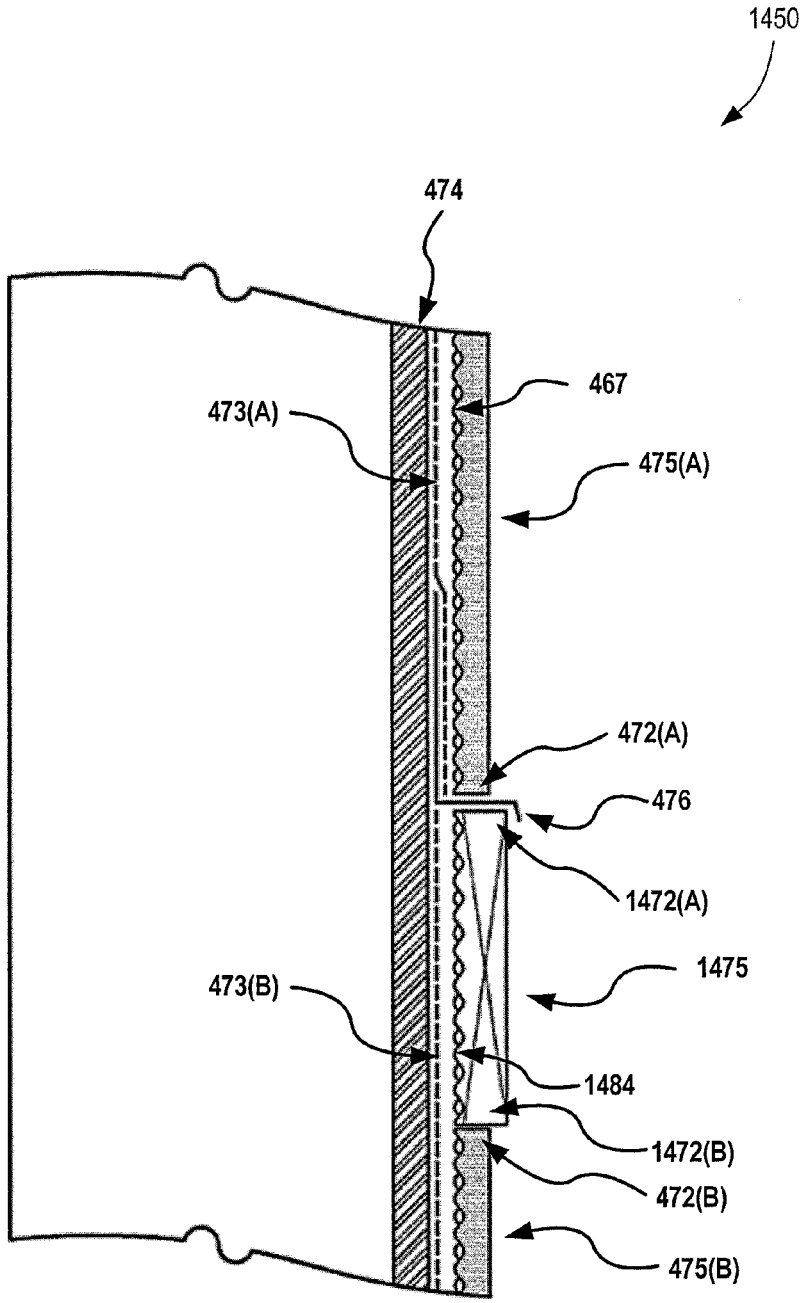
FIG. 14B is a side view of a vented and water control trim-board/molding utilizing an egg-crate or other three-dimensional pattern and secured to a structure, according to an embodiment.

FIG. 14B shows a side view of one exemplary vented and water control trim-board/molding 1475 secured to a structure, similar to the structure shown in FIG. 6. In the examples of FIG. 14(B), trim-board/molding 1475 is butt jointed with siding 475(A), 475(B) with flashing 476 positioned between flat surface 472(A) and a substantially flat surface 1472(A) of trim-board/molding 1475 such that trim-board/molding 1475 is substantially in the same plane as siding 475(A), 475(B). Flashing 476 is secured to sheathing 474, for example by nails or screws (not shown), with a weather resistant barrier 473(A) overlaid on top of the upper portion of flashing 476. It will be understood that other methods of joining trim-board/molding 1475 with a siding may be utilized without departing from the scope herein, examples of which include but not limited to, lap joint, overlay, etc.

The example of a pattern utilized on the trim-board/molding of FIG. 14(B) is an egg crate pattern 1484. Egg crate pattern 1484 is merely an exemplary structure that facilitates ventilation and water control and is not meant to limit the type, design, size, or configuration of the ventilation and water control raised pattern. In the embodiment of FIG. 14B, the raised patterns are integrally manufactured into the trim-board/molding product. The water control trim-board/molding may, for example, be stamped, embossed, or otherwise formed with a raised surface omnidirectional pattern that provides an air space for ventilation and a drainage plane between the sheathing 474 and the trim-board/molding 1475. The omnidirectional nature of patterns 1484 allows trim-board/molding 1475 to be installed in any orientation without affecting the ventilation and water control properties.

Water control trim-board/molding 1475 may be manufactured using a number of different materials, examples of which include, but are not limited to, fiber cement, hardboard, OSB, PVC, wood fiber/resin composite, gypsum, foam, foam insulation, and glass fiber reinforced plastic composite.

While the present invention has been described above, it should be clear that many changes and modifications may be made to the process and product without departing from the spirit and scope of this invention. For example, although pattern 706 is illustrated as a non-directional assortment of round bumps, other omnidirectional raised patterns (pyramids, squares, squiggles or other geometric or random shapes) may also provide drainage channels therebetween. Likewise, a sunken pattern of incuts may be formed into face 704 in place of or in addition to raised surface features 704, such that face 704 provides for attachment to an exterior finish, such as siding or cladding, and the incut pattern forms channels 710.

Figure 15:
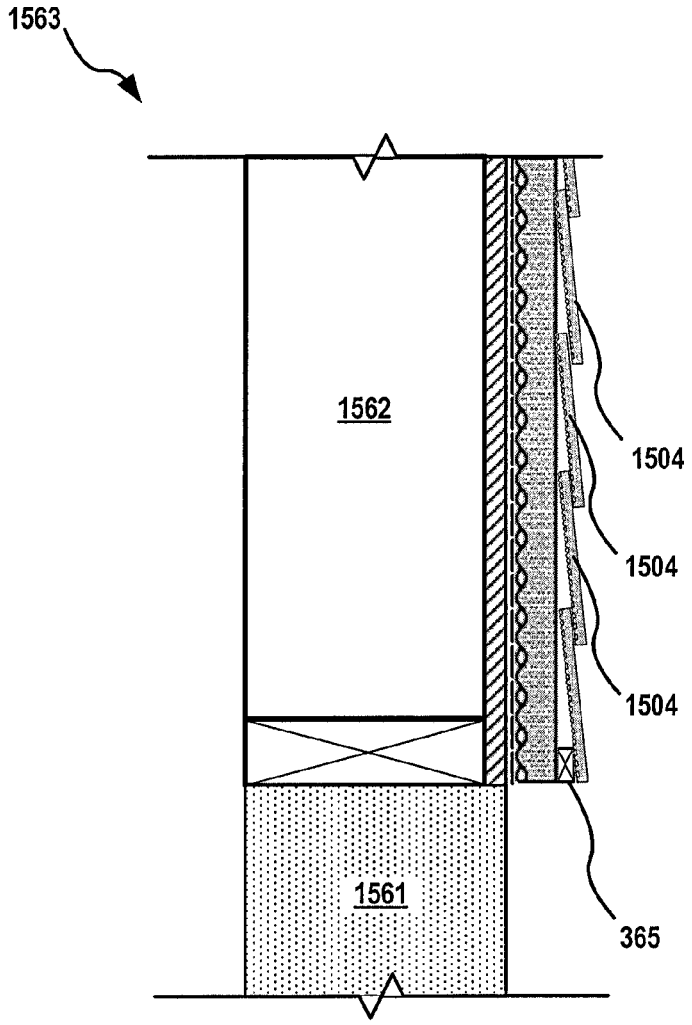
FIG. 15 depicts a cross-section view of an exterior surface of a structure including insulation having an omnidirectional relief pattern thereon, in one embodiment.

Patterned Insulation:

FIG. 15 depicts a cross-sectional view of a structure having an insulation including an omnidirectional relief pattern. Structure 1563 includes sheathing 1554 fixed to a frame 1562 that is set on a foundation 1561. In the embodiment of FIG. 15, sheathing 1554 is a standard sheathing without an omnidirectional relief pattern. Sheathing 1554 may include an optional weather resistant barrier 1556 on the exterior facing surface of sheathing 1556. Insulation 1502 is located exterior to sheathing 1554, or optionally weather resistant barrier 1556. Insulation 1502 is depicted having a grid pattern array of raised bumps forming an omnidirectional relief pattern for providing a drainage and ventilation path between sheathing 1554 and insulation 1502. Exterior to insulation 1502 is lapped siding boards 1504. An optional starter strip 1565 may space the bottom portion of the lowest siding board 1504 from insulation 1502. Siding boards 1504 may be similar to any of siding boards 110, 210, 262, 322, 372. Alternatively panel siding such as siding 410, 420, 465, or 475, could be exterior to insulation 1502. Therefore, an omnidirectional drainage and ventilation path is created between insulation 1502 and the siding exterior thereto.

Although insulation 1502 is illustrated having omnidirectional relief pattern on the interior surface thereof, in an alternate embodiment, insulation 1502 may have an omnidirectional relief pattern on both the interior surface and the exterior surface thereof. Therefore, standard sheathing and standard siding or cladding may be attached to insulation 1502 while maintaining an omnidirectional drainage and relief path between each layer.

Figure 16:
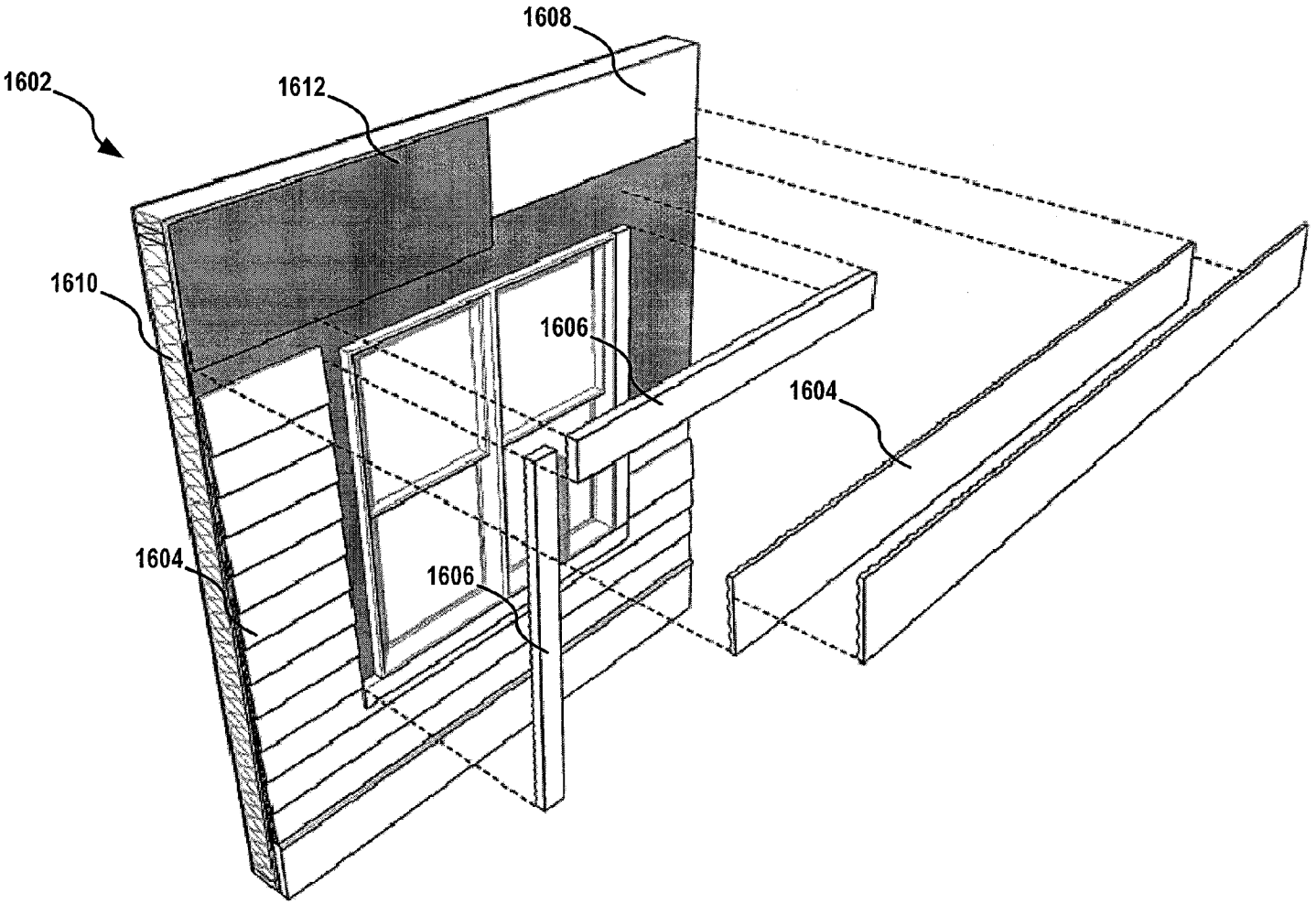
FIG. 16 depicts an environmental view of an exterior surface of a structure including siding having an omnidirectional relief pattern, and trim-board having an omnidirectional relief pattern, in one embodiment.

FIG. 16 depicts an environmental view of an exterior surface 1602 of a structure including siding 1604 having an omnidirectional relief pattern, and trim-board 1606 having an omnidirectional relief pattern, in one embodiment. Surface 1602 may include standard sheathing 1608 attached to framing 1610 of the structure. Sheathing 1608 may further include a weather resistant barrier 1612 located on the exterior surface thereof. Siding 1604 is attached exterior to sheathing, and optional weather resistant barrier 1612. The omnidirectional relief pattern, such as a grid pattern of raised bumps as discussed above (raised dots, egg crate pattern, or raised elements such as a pyramids, squares, rectangles, etc.) on the interior surface of siding 1604 creates an omnidirectional path for moisture drainage and air ventilation. Siding 1604 similar to, and include the above discussed features of, any of siding boards 110, 210, 262, 322, 372. Alternatively siding 1604 may be similar to, and include the above discussed features of, any of panel siding 410, 420, 465, or 475, discussed above. Trim-board 1606 is attached exterior to sheathing, and optional weather resistant barrier 1612. The omnidirectional relief pattern, such as a grid pattern of raised bumps as discussed above (raised dots, egg crate pattern, or raised elements such as a pyramids, squares, rectangles, etc.) on the interior surface of trim-board 1606 creates an omnidirectional path for moisture drainage and air ventilation. Trim-board 1606 may be similar to, and include the above discussed features of, trim-board 1465 or 1475.

Figure 17:
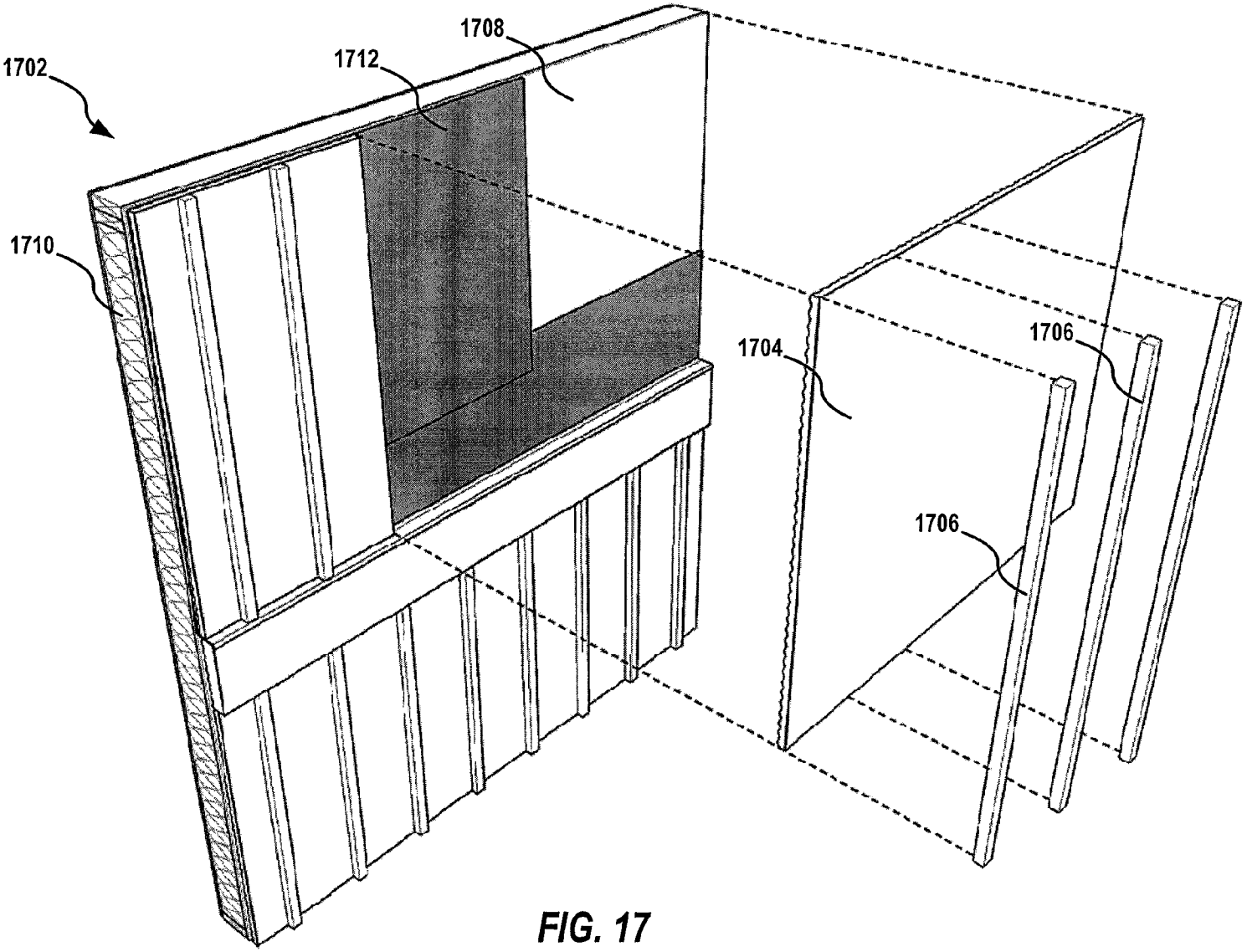
FIG. 17 depicts an environmental view of an exterior surface of a structure including a siding, or cladding, panel having an omnidirectional relief pattern on the back side thereof, with optional battens on the exterior surface thereof, in one embodiment.

FIG. 17 depicts an environmental view of an exterior surface 1702 of a structure including a siding, or cladding, panel 1704 having an omnidirectional relief pattern on the back side thereof, with optional battens 1706 on the exterior surface thereof, in one embodiment. Surface 1702 may include standard sheathing 1708 attached to framing 1710 of the structure. Sheathing 1708 may further include an optional weather resistant barrier 1712 located on the exterior surface thereof. Siding or cladding panels 1704 are attached exterior to sheathing, and optional weather resistant barrier 1712. The omnidirectional relief pattern, such as a grid pattern of raised bumps as discussed above (raised dots, egg crate pattern, or raised elements such as a pyramids, squares, rectangles, etc.) on the interior surface of siding or cladding 1704 creates an omnidirectional path for moisture drainage and air ventilation. Siding or cladding 1704 similar to, and include the above discussed features of, any of siding panels 410, 420, 465, or 475. Battens 1706 may be included on the exterior surface of panels 1704 to create a board and batten look on the exterior surface of the structure, while still maintaining an omnidirectional path for moisture drainage and air ventilation.

Omnidirectional drainage and ventilation provides significant advantages. As compared to linear drainage and ventilation systems, such as those with horizontal or vertical grooves or protrusions, the omnidirectional path provides an easier path for drainage and ventilation. Further, should one path get impeded, for example by dirt and debris, the air and moisture is easily redirected through another path. Moreover, the omnidirectional relief pattern may be manufactured using pressboard molding, stamping, or otherwise engraving. This simplifies manufacturing and thereby reduces associated costs. Further, because the omnidirectional relief pattern is not limited to a particular direction, large panels may be manufactured with the omnidirectional relief pattern and then cut into smaller sections without concern for the direction of the relief pattern. Additionally, where sheathing or insulation includes an omnidirectional relief pattern on an exterior (or interior) facing surface thereof, standard siding may be utilized while still achieving the moisture drainage and air ventilation benefits discussed herein.

Features described above as well as those claimed below may be combined in various ways without departing from the scope hereof. The following examples illustrate some possible, non-limiting combinations:

(A1) A vented and water control panel for securing to the exterior of a structure, the panel including an omnidirectional relief pattern formed on a back surface of the vented and water control panel.

(A2) In the vented and water control panel of (A1), wherein the omnidirectional relief pattern font's an omnidirectional ventilation and drainage plane.

(A3) In either of the vented and water control panels of (A1) or (A2), wherein the omnidirectional relief pattern is formed as a grid pattern of raised elements.

(A4) In the vented and water control panel of (A3), wherein the raised elements are raised bumps or "dots" with air space on all sides.

(A5) In the vented and water control panel of (A3), wherein the raised elements are in an egg-crate pattern.

(A6) In any of the vented and water control panels of (A1) through (A5), further comprising a securing hole on a front surface of vented and water control panel that corresponds to at least one element of the omnidirectional relief pattern.

(A7) In any of the vented and water control panels of (A1) through (A6), further comprising overlapping structures for installing a first vented and water control panel substantially coplanar with a second, adjacent vented and water control panel.

(A8) In any of the vented and water control panels of (A1) through (A7), wherein the back surface has a top and a bottom and a raised element at the bottom of the back side has a height that is greater than a raised element at the top of the back side.

(A9) In any of the vented and water control panels of (A1) through (A7), wherein the back surface has a top and a bottom and a raised element at the top of the back side has a height that is greater than a raised element at the bottom of the back side.

(A10) In any of the vented and water control panels of (A1) through (A9), wherein the omnidirectional drainage plane forms an omnidirectional path, such that moisture and/or air may move substantially unimpeded along the siding's length and width.

(A11) In any of the vented and water control panels of (A1) through (A10), the panel being formed as a trim board panel.

(A12) In any of the vented and water control panels of (A1) through (A10), the panel being formed as siding.

(A13) In any of the vented and water control panels of (A1) through (A10), the panel being formed as cladding.

(A14) In any of the vented and water control panels of (A1) through (A10), the panel being formed as insulation, wherein an additional omnidirectional relief pattern formed on a front surface of the vented and water control panel; wherein the additional omnidirectional relief pattern forms an additional omnidirectional ventilation and drainage plane for moving water and water vapor.

(A15) In any of the vented and water control panels of (A1) through (A14), further comprising a weather resistant barrier applied to the omnidirectional relief pattern.

(A16) In the vented and water control panel of (A15), wherein the weather resistant barrier is applied in liquid form.

(A17) In the vented and water control panel of (A16), wherein the weather resistant barrier is applied by spraying, painting or dipping the outer face.

(A18) In any of the vented and water control panels of (A1) through (A17), the panel being formed from foam material, wherein the omnidirectional relief pattern are integral with an outer face of the panel.

(B1) A vented and water control panel sheathing, including a panel body having an outer face, and an inner face; a plurality of raised surface features extending from the outer face in the form of an omnidirectional relief pattern to provide points of contact between the panel body and an exterior finish, when the exterior finish is applied with the sheathing; and a plurality of channels formed between the raised surface features to facilitate omnidirectional draining and/or ventilation between the panel and the applied exterior finish.

(B2) In the vented and water control panel sheathing of (B1), the panel sheathing further comprising a weather resistant barrier applied to the outer face, including the raised surface features and the channels.

(B3) In the vented and water control panel sheathing of (B2), wherein the weather resistant barrier is applied in liquid form.

(B4) In the vented and water control panel sheathing of (B3), wherein the weather resistant barrier is applied by spraying, painting or dipping the outer face.

(B5) In any of the vented and water control panel sheathings of (B1) through (B4), wherein the vented and water control panel sheathing is an Oriented Strand Board (OSB) panel and the raised surface features are fondled from smaller wood strands forming the outer face; wherein strands of the inner face and/or core are larger than the strands of the outer face.

(B6) In the vented and water control panel sheathing of (B5), wherein the raised surface features are stamped or embossed into the outer face.

(B7) In the vented and water control panel sheathing of (B5), the panel sheathing being formed from foam material, wherein the raised surface features are integral with the outer face.

(B8) In any of the vented and water control panel sheathings of (B1) through (B7), the raised surface comprising a plurality of dots protruding from the outer face.

(B9) In any of the vented and water control panel sheathings of (B1) through (B7), the omnidirectional relief pattern comprising an egg-crate pattern of the raised elements.

(B10) In any of the vented and water control panel sheathings of (B1) through (B9), further comprising another plurality of raised features extending from the inner face in the form of an omnidirectional relief pattern to provide points of contact between the panel body and an interior support of a building, when the sheathing is installed on the building.

(B11) In the vented and water control panel sheathing of (B10), the interior support being a roof rafter of the building.

(C1) A structure having improved water drainage and air ventilation, the structure comprising: a first layer having an interior facing surface and an exterior facing surface, the exterior facing surface having an omnidirectional relief pattern of raised elements thereon; wherein the omnidirectional relief pattern forms an omnidirectional ventilation and drainage plane.

(C2) In the structure of (C1), the first layer being a siding layer, the omnidirectional relief pattern forming contact points between the siding layer and an internal layer of the structure.

(C3) In any of the structures of (C1) through (C2), the internal layer including a weather resistant layer.

(C4) In any of the structures of (C1) through (C3), the internal layer being a sheathing layer.

(C5) In any of the structures of (C1) through (C4), the first layer being a lapped siding layer, the omnidirectional relief pattern further forming contact points between a first siding board of the lapped siding layer and an exterior surface of an adjacent siding board of the lapped siding layer.

(C6) In any of the structures of (C1) through (C5), the first layer comprising a trim-board layer, the omnidirectional relief pattern forming contact points between the trim-board layer and an internal layer of the structure.

(C7) In any of the structures of (C1) through (C4), the first layer being a sheathing layer, the omnidirectional relief pattern foaming contact points between the sheathing layer and an external layer of the structure.

(C8) In the structure of (C7), the external layer being one or more of a siding layer, a cladding layer, a trim-board layer, and a weather resistant layer.

(C9) In any of the structures of (C7) through (C8), the sheathing layer further comprising another omnidirectional relief pattern of raised elements on the interior facing surface.

(C10) In the structure of (C9), the sheathing layer being attached to sidewall framing of the structure.

(C11) In the structure of (C9), the sheathing layer being attached to a rafter of a roof of the structure.

(C12) In any of the structures of (C1) through (C11), the omnidirectional relief pattern being a grid pattern of raised elements.

(C13) In the structure of (C12), wherein the raised elements are raised bumps or "dots" with air space on all sides.

(C14) In the structure of (C12), wherein the raised elements are in an egg-crate pattern.

(C15) In any of the structures of (C12) through (C14), wherein the raised elements differ in height from a top to a bottom of the first layer.

(C16) In any of the structures of (C12) through (C14), wherein the raised elements differ in height from a bottom to a top of the first layer.

(C17) In any of the structures of (C3) through (C16), wherein the weather resistant barrier is applied in liquid form.

(C18) In the structure of (C17), wherein the weather resistant barrier is applied by spraying, painting or dipping the outer face.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A vented and water control weatherproofing product for securing to an exterior of a structure, comprising:

a unitary exterior weatherproofing panel of one piece construction having a front surface exposed to an ambient environment and a back surface, the back surface including an omnidirectional relief pattern comprised of a plurality of raised elements projecting from the back surface;

wherein the omnidirectional relief pattern forms an omnidirectional ventilation and drainage plane; and wherein the unitary exterior weatherproofing panel comprises an overlap region on the back surface for overlapping a second unitary exterior weatherproofing panel; wherein the overlap region does not include the omnidirectional relief pattern.

2. The vented and water control weatherproofing product of claim 1, the exterior weatherproofing panel being a trim board panel.

3. The vented and water control weatherproofing product of claim 1, the exterior weatherproofing panel being a cladding panel.

4. A vented and water control weatherproofing product for securing to an exterior of a structure, comprising:

a unitary siding panel of one piece construction having a front siding surface and a back surface, the back surface including an omnidirectional relief pattern comprised of a plurality of raised elements projecting from the back surface;

wherein the omnidirectional relief pattern forms an omnidirectional ventilation and drainage plane; and wherein the unitary siding panel comprises an overlap region on the back surface for overlapping a second unitary siding panel; wherein the overlap region does not include the omnidirectional relief pattern.

5. The vented and water control weatherproofing product of claim 4, wherein the overlap region is configured to create a seal between the unitary siding panel and a front surface of the second unitary siding panel.

6. The vented and water control weatherproofing product of claim 4, wherein the omnidirectional drainage plane forms an omnidirectional flow path, such that at least one of moisture and air moves substantially unimpeded along a length and width of the siding panel.

7. The vented and water control weatherproofing product of claim 4, the unitary siding panel further comprising a first overlapping structure for installing the unitary siding panel substantially coplanar with a second, adjacent, unitary siding panel having a second overlapping structure cooperating with the first overlapping structure.

8. The vented and water control weatherproofing product of claim 4, further comprising a second unitary siding panel of one piece construction having a front surface and a back surface, the back surface of the second siding panel including an additional omnidirectional relief pattern;

wherein the omnidirectional relief pattern of the first siding panel is adapted to form contact points on the front surface of the second siding panel.

9. The vented and water control weatherproofing product of claim 4, the omnidirectional relief pattern having a thickness of ⅛ of an inch and a separation distance of ½ of an inch between each said raised element of the omnidirectional relief pattern.

10. The vented and water control weatherproofing product of claim 4, further comprising a second unitary siding panel of one piece construction having a front surface and a back surface, the back surface of the second siding panel including an additional omnidirectional relief pattern; the first and second siding panels further comprising corresponding butt joints for installing the siding panels in substantially a same plane.

11. The vented and water control weatherproofing product of claim 4, further comprising a second unitary siding panel of one piece construction having a front surface and a back surface, the back surface of the second siding panel including an additional omnidirectional relief pattern; the front surface of the first siding panel having at least one securing hole that respectively corresponds with a raised element of the omnidirectional relief pattern of the second siding panel.

12. The vented and water control weatherproofing product of claim 4, wherein the plurality of raised elements are positioned in a grid pattern.

13. The vented and water control weatherproofing product of claim 12, wherein the raised elements are raised bumps or dots with air space on all sides.

14. The vented and water control weatherproofing product of claim 12, wherein the raised elements are in an egg-crate pattern.

15. The vented and water control weatherproofing product of claim 12, wherein the back surface has a top and a bottom and one of said raised elements at the bottom of the back surface has a height that is greater than another of said raised elements at the top of the back surface.

16. The vented and water control weatherproofing product of claim 12, wherein the back surface has a top and a bottom and one of said raised elements at the top of the back surface has a height that is greater than another of said raised elements at the bottom of the back surface.

17. The vented and water control weatherproofing product of claim 4, further comprising a second unitary siding panel of one piece construction having a front surface and a back surface, the back surface of the second siding panel including an additional omnidirectional relief pattern; the first and second siding panels having corresponding overlapping structures for aligning the first and second siding panels in substantially a same plane.

18. The vented and water control weatherproofing product of claim 17, the omnidirectional relief pattern of each panel being located on the back surface but not the overlapping structure.

19. A system for facilitating water drainage and air ventilation, the system comprising:

a structure having a surface layer; and a unitary exterior weatherproofing panel of one piece construction for securing to the surface layer of the structure, the exterior weatherproofing panel having an interior facing surface and an exterior facing surface, the interior facing surface having an omnidirectional relief pattern of raised elements thereon and projecting therefrom;

the interior facing surface disposed adjacent to the surface layer of the structure;

wherein the omnidirectional relief pattern forms an omnidirectional ventilation and drainage plane; and wherein the unitary exterior weatherproofing panel comprises an overlap region on the interior facing surface for overlapping a second unitary exterior weatherproofing panel; wherein the overlap region does not include the omnidirectional relief pattern.

20. The system of claim 19, the unitary exterior weatherproofing panel comprising a first lapped siding panel, and the structure further comprising a second lapped siding panel of one piece construction, each siding panel respectively having the exterior facing surface and the interior facing surface having the omnidirectional relief pattern of raised elements thereon;

wherein the omnidirectional relief pattern of the first siding panel forms contact points on the exterior facing surface of the second siding panel when the first and second siding panels are adjacent to each other.

21. The system of claim 19, the omnidirectional relief pattern positioned in a grid pattern of said raised elements.

22. The system of claim 19, the omnidirectional relief pattern having a thickness of ⅛ of an inch and a separation distance of ½ of an inch between each said raised element of the omnidirectional relief pattern.

23. The system of claim 19, wherein the exterior weatherproofing panel is a first siding panel, and further comprising a second siding panel, each siding panel being of one piece construction, each siding panel having the exterior facing surface and the interior facing surface having the omnidirectional relief pattern of raised elements thereon, the first and second panel joining at a butt joint such that the first and second panels are substantially in a same plane; the structure further comprising a flashing located behind at least one of the first and second siding panels and between the butt joint.

24. The system of claim 19, wherein the exterior weatherproofing panel is a first siding panel, and further comprising a second siding panel, each siding panel being of one piece construction, the exterior surface of the first siding panel having at least one securing hole that corresponds with a respective raised element of the omnidirectional relief pattern of the second siding panel.

25. The system of claim 19, the exterior weatherproofing panel being a siding panel, the omnidirectional relief pattern forming contact points between the siding panel and the surface layer of the structure.

26. The system of claim 25, the surface layer of the structure including a weather resistant layer.

27. The system of claim 25, the surface layer of the structure including a sheathing layer.

28. The system of claim 19, the exterior weatherproofing panel comprising a trim-board panel, the omnidirectional relief pattern forming contact points between the trim-board panel and the surface layer of the structure.

29. The system of claim 28, the surface layer of the structure being at least one of a weather resistant layer and a sheathing layer.

30. The system of claim 19, the surface layer of the structure being a sheathing layer, the omnidirectional relief pattern forming contact points between the sheathing layer and the exterior weatherproofing panel.

31. The system of claim 30, the exterior weatherproofing panel being at least one of a siding panel, a cladding layer, and a trim-board panel.

32. The system of claim 30, the sheathing layer further comprising another omnidirectional relief pattern of raised elements on a surface thereof.

33. The system of claim 32, the sheathing layer being attached to sidewall framing of the structure.

34. The system of claim 32, the sheathing layer being attached to a rafter of a roof of the structure.

35. The system of claim 19, wherein the exterior weatherproofing panel is a first siding panel, and further comprising a second siding panel, each siding panel being of one piece construction, the first and second siding panels having corresponding overlapping structures for aligning the first and second siding panels in substantially a same plane.

36. The system of claim 35, the omnidirectional relief pattern of each panel being located on the back surface but not the overlapping structure.

* * * * *